US008752945B2

(12) United States Patent
Shirono et al.

(10) Patent No.: US 8,752,945 B2
(45) Date of Patent: Jun. 17, 2014

(54) CARTRIDGES

(71) Applicant: Brother Kogyo Kabushiki Kaisha, Nagoya (JP)

(72) Inventors: Taichi Shirono, Nagoya (JP); Noritsugu Ito, Tokoname (JP); Suguru Tomoguchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/627,805

(22) Filed: Sep. 26, 2012

(65) Prior Publication Data

US 2013/0083139 A1 Apr. 4, 2013

(30) Foreign Application Priority Data

Sep. 30, 2011 (JP) ..... 2011-218728
Sep. 30, 2011 (JP) ..... 2011-218729

(51) Int. Cl.
*B41J 2/175* (2006.01)

(52) U.S. Cl.
USPC ..... 347/86

(58) Field of Classification Search
USPC ..... 347/85, 87; 346/86
See application file for complete search history.

(56) References Cited

U.S. PATENT DOCUMENTS

| | | | | |
|---|---|---|---|---|
| 4,855,762 | A * | 8/1989 | Suzuki | 347/86 |
| 5,805,180 | A * | 9/1998 | Ebisawa et al. | 347/23 |
| 5,907,343 | A | 5/1999 | Takemura et al. | |
| 6,267,476 | B1 | 7/2001 | Kato et al. | |
| 6,350,022 | B1 * | 2/2002 | Takemura et al. | 347/85 |
| 6,830,321 | B2 * | 12/2004 | Okamoto et al. | 347/86 |
| 6,959,984 | B2 * | 11/2005 | Ogura et al. | 347/86 |
| 7,997,701 | B2 | 8/2011 | Yazawa | |

FOREIGN PATENT DOCUMENTS

| | | | |
|---|---|---|---|
| JP | H03-173648 | A | 7/1991 |
| JP | H07-052400 | A | 2/1995 |
| JP | H11-011000 | A | 1/1999 |
| JP | 2002-307705 | A | 10/2002 |
| JP | 2005-212138 | A | 8/2005 |
| JP | 2005-305879 | A | 11/2005 |

* cited by examiner

*Primary Examiner* — Anh T. N. Vo
(74) *Attorney, Agent, or Firm* — Baker Botts L.L.P.

(57) ABSTRACT

A cartridge including: an engagement portion disposed on a first surface facing a first direction, a first reservoir storing a first liquid including a colorant, a second reservoir storing a second liquid having a characteristic of coagulating the colorant, and a third reservoir storing a third liquid including water. Each of the first, the second, and the third reservoirs includes an outlet portion that directs liquid from an interior of the respective reservoirs to an exterior of the cartridge in a second direction perpendicular to the first direction. The outlet portions of the first, the second, and the third reservoirs do not overlap each other in the first direction.

23 Claims, 16 Drawing Sheets

CARTRIDGES

CROSS-REFERENCE TO RELATED APPLICATIONS

This application claims priority from Japanese Patent Application No. 2011-218728, filed on Sep. 30, 2011, and Japanese Patent Application No. 2011-218729, filed on Sep. 30, 2011. The disclosures of these applications are incorporated herein by reference.

BACKGROUND OF THE INVENTION

1. Field of the Invention

The invention relates generally to cartridges for storing liquid.

2. Description of Related Art

A known liquid ejecting apparatus includes two cartridges. One of the cartridges stores ink and the other of the cartridges stores an improving liquid. The known liquid ejecting apparatus further includes two heads. One of the heads is configured to eject ink supplied from the cartridge that stores the ink and the other of the heads is configured to eject the improving liquid supplied from the cartridge that stores the improving liquid. The improving liquid improves the recordability of ink.

Another known liquid ejecting apparatus is configured to perform a preliminary ejection, e.g., purging or flushing, to reduce clogging in nozzles of a head. However, the preliminary ejection wastes the ink and the improving liquid. Therefore, frequent performance of the preliminary ejection is not economical. To reduce the frequency of the preliminary ejection, the known liquid ejecting apparatus includes a capping unit configured to seal an area opposite to a surface having the nozzles of the head with a cap and to maintain humidity in the area, in addition to the preliminary ejection.

SUMMARY OF THE INVENTION

Humidifying liquid may also be stored in a cartridge like the above-described ink and improving liquid, but not in a tank fixed to the liquid ejecting apparatus. The cartridge is configured to be attachable to and removable from the liquid ejecting apparatus. Thus, the ink, the improving liquid, and the humidifying liquid may be stored in their respective liquid cartridges. Therefore, a user may need to attach or remove each of the cartridges to or from the liquid ejecting apparatus individually. Accordingly, a process of installing or removing the cartridges to or from the liquid ejecting apparatus may become complicated or inconvenient.

The present invention may provide a liquid cartridge configured to accomplish supply of three different kinds of liquid to the liquid ejecting apparatus while facilitating installation and removal of the liquid cartridge with respect to the liquid ejecting apparatus.

According to an embodiment of the invention, a cartridge, comprising: an engagement portion disposed on a first surface facing a first direction; a first reservoir storing a first liquid comprising a colorant; a second reservoir storing a second liquid comprising a characteristic of coagulating the colorant; and a third reservoir storing a third liquid comprising water, wherein each of the first, the second, and the third reservoirs comprises an outlet portion configured to direct liquid from an interior of the respective reservoirs to an exterior of the cartridge in a second direction perpendicular to the first direction, and wherein the outlet portions of the first, the second, and the third reservoirs do not overlap each other in the first direction.

According to another embodiment of the invention, a cartridge, comprising: a first reservoir storing a first liquid comprising a colorant; a second reservoir storing a second liquid comprising a characteristic of coagulating the colorant; and a third reservoir storing a third liquid comprising water, without colorant or liquid comprising characteristic of coagulating colorants.

According to still another embodiment of the invention, a cartridge, comprising: an engagement portion disposed on a first surface facing a first direction; a first reservoir; a second reservoir; and a third reservoir, wherein each of the first, the second, and the third reservoirs comprises an outlet portion extending in a second direction perpendicular to the first direction and configured to communicate an interior of the respective reservoirs with an exterior of the cartridge, and wherein the outlet portions of the first, the second, and the third reservoirs do not overlap each other in the first direction.

Other objects, features, and advantages will be apparent to persons of ordinary skill in the art from the following detailed description of the invention and the accompanying drawings.

DESCRIPTION OF THE DRAWINGS

For a more complete understanding of the present invention, needs satisfied thereby, and the objects, features, and advantages thereof, reference now is made to the following descriptions taken in connection with the accompanying drawing.

DETAILED DESCRIPTION OF EMBODIMENT OF THE INVENTION

Figure 1:
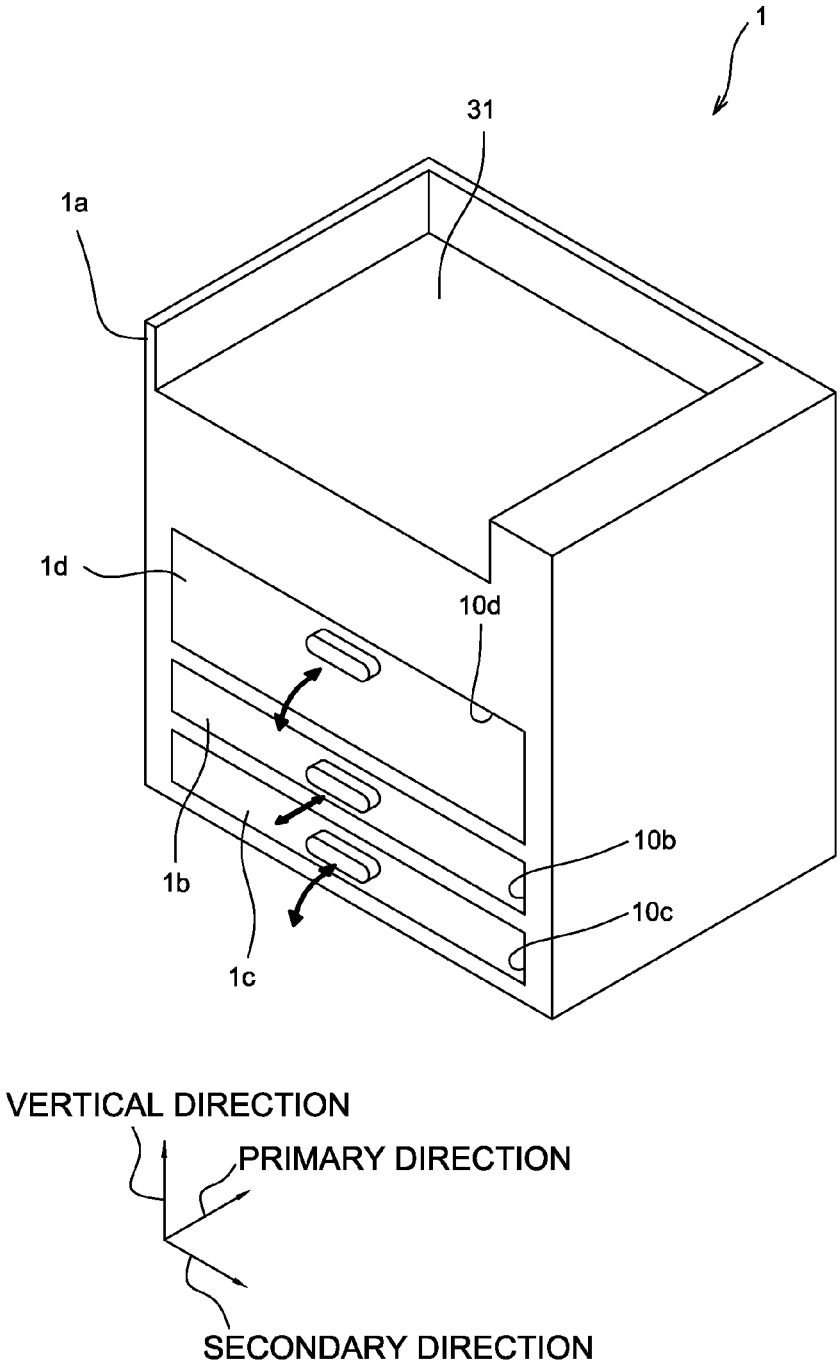
FIG. 1 is a perspective view depicting an inkjet printer according to an embodiment of the invention.

Embodiments of the invention now are described in detail with reference to the accompanying drawings; like reference numerals are used for corresponding parts in the various drawings.

Figure 2:
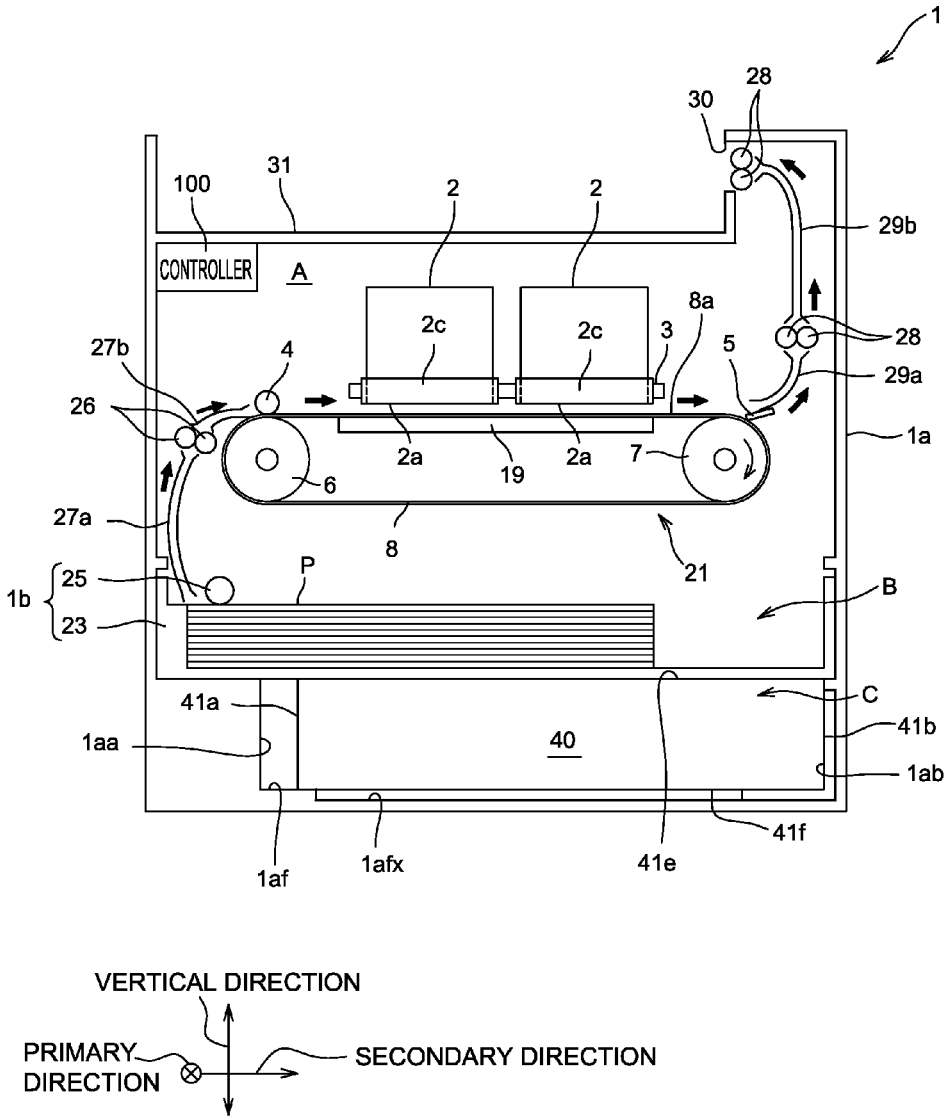
FIG. 2 is a schematic side view depicting an internal structure of a printer according to an embodiment of the invention.

Referring to FIG. 1, a liquid ejecting apparatus, e.g., an inkjet printer 1, may comprise a main unit and a liquid cartridge 40, as depicted in FIG. 2, configured to be mounted to the main unit. The main unit of the printer 1 may comprise a housing 1*a* having substantially a rectangular parallelepiped shape. A sheet discharge portion 31 may be disposed at the top of the housing 1*a*. The housing 1*a* may have three openings 10*d*, 10*b*, and 10*c* formed in one of its vertically extending outer surfaces, e.g., a front surface of the printer 1. The openings 10*d*, 10*b*, and 10*c* may be vertically aligned in this order from top to bottom when the printer 1 is oriented vertically, as depicted in FIG. 1. A sheet feed unit 1*b* and a cartridge 40, e.g., as depicted in FIG. 2, may be removably inserted into the housing 1*a* through the openings 10*b* and 10*c*, respectively. The main unit of the printer 1 may comprise a door 1*d* fitted into the opening 10*d* and configured to pivot about a horizontal axis at a lower end of the door 1*d*. The door 1*d* may is pivot to selectively cover and expose the opening 10*d*. As depicted in FIG. 2, the door 1*d* may comprise an interior surface facing a transport unit 21 interior to the printer 1 in a primary direction. The printer 1 may further comprise a cover 1*c* disposed in the opening 10*c* and configured to pivot about a horizontal axis at a lower end of the cover 1*c*. When the cover 1*c* is closed while the cartridge 40 is mounted in the inside of the housing 1*a*, the cover 1*c* may prevent the cartridge 40 from falling from the housing 1*a* of the printer 1.

Referring to FIG. 2, an interior of the housing 1*a* may be divided into spaces A, B, and C in the vertical direction in this order from top to bottom. Two heads 2, the transport unit 21, and a controller 100 may be disposed in the space A. The heads 2 may be configured to discharge black ink and pretreatment liquid, respectively. Hereinafter, the black ink, the pretreatment liquid, and humidifying liquid may be collectively referred to as liquid, respectively. The controller 100 may be configured to control operations of the components of the printer 1. The sheet feed unit 1*b* may be disposed in the space B, and the cartridge 40 may be disposed in the space C. The space C may be a portion that receives the cartridge 40, e.g., a cartridge receiving portion, in the main unit. The space C may comprise portions other than the cartridge 40 mounted in the printer 1. A sheet transport path, along which sheets P may be transported, may be formed in the housing 1*a*. The sheet transport path may extend from the sheet feed unit 1*b* toward the sheet discharge portion 31, as indicated by the bold arrows in FIG. 2.

Figure 12:
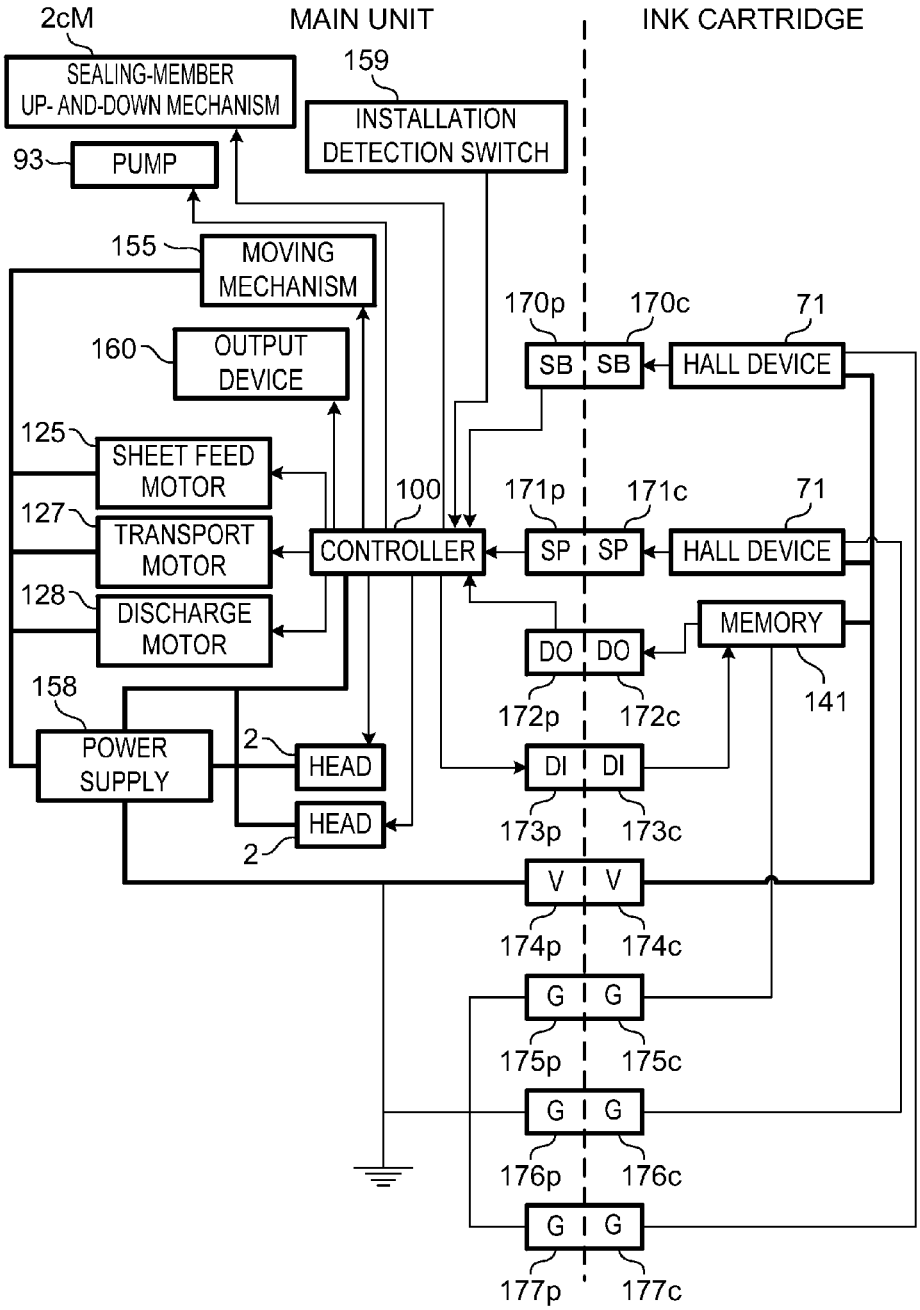
FIG. 12 is a block diagram depicting an electrical configuration of a cartridge and a main unit of a printer according to an embodiment of the invention.

The controller 100 may comprise a central processing unit (CPU), a read-only memory (ROM), a random access memory (RAM), such as a nonvolatile RAM, and an interface. The ROM may be configured to store programs to be executed by the CPU and various fixed data. The RAM may be configured to temporarily store data, e.g., image data, for the CPU to execute programs. The controller 100 may be configured to transmit and receive data to and from a memory 141, e.g., as depicted in FIG. 12, and Hall devices 71, e.g., Hall effect sensor, of the cartridge 40. Further, the controller 100 may be configured to transmit and receive data to and from an external device, e.g., a personal computer connected to the printer 1, via the interface.

The sheet feed unit 1*b* may comprise a tray 23 and a roller 25. The tray 23 may be configured to be detachably attached to the housing 1*a* along the primary direction. The tray 23 may have a substantially box shape and may open upward. The tray 23 may be configured to accommodate sheets P of various sizes. As depicted in FIG. 12, a sheet feed motor 125 that may be controlled by the controller 100, may drive the roller 25, which may be configured to feed the topmost sheet P from the tray 23 when driven by the roller 25. The sheet P fed by the roller 25 may be sent to the transport unit 21 while being guided by guides 27*a* and 27*b* and while being nipped by a pair of feed rollers 26.

The transport unit 21 may comprise two rollers 6 and 7 and an endless transport belt 8. The transport belt 8 may be wound around the rollers 6 and 7. The roller 7 may be a driving roller configured to rotate in the clockwise direction, as depicted in FIG. 2. Specifically, referring to FIG. 12, when a shaft of the roller 7 is driven by a transport motor 127 controlled by the controller 100, the roller 7 may receive a driving force from the transport motor 127. Referring to FIG. 2, the roller 6 may be a driven roller configured to rotate in the clockwise direction, as depicted in FIG. 2, along with the running of the transport belt 8 caused by the rotation of the roller 7. A platen 19 having a substantially rectangular parallelepiped shape may be disposed within the loop of the transport belt 8. An outer surface 8*a* of the transport belt 8 at an upper portion of the loop may face lower surfaces 2*a* of the heads 2, and may extend substantially in parallel with the lower surfaces 2*a* with a gap formed between the lower surfaces 2*a* and the outer surface 8*a*. The platen 19 may support an inner surface of the transport belt 8 at the upper portion of the loop of the transport belt 8. The lower surface 2*a* of each head 2 may be a discharge surface where a plurality of discharge nozzles for discharging ink may be formed. A silicone layer having a low adhesive property may be formed on the outer surface 8*a* of the transport belt 8. A pressing roller 4 may press the sheet P, which is fed out from the sheet feed unit 1*b* toward the transport unit 21, against the outer surface 8*a* of the transport belt 8. While the outer surface 8*a* of the transport belt 8 holds the sheet P by the adhesive property of the outer surface 8*a*, the transport belt 8 may transport the sheet P in a secondary direction as indicated by the bold arrows in FIG. 2.

The secondary direction may be parallel to a transport direction in which the transport unit 21 may transport the sheet P. The primary direction may be perpendicular to the secondary direction. Each of the primary direction and the secondary direction may be a horizontal direction.

When the sheet P held on the outer surface 8*a* of the transport belt 8 passes below the heads 2, the controller 100 may control the heads 2 to discharge one or both of the black ink and the pretreatment liquid from the lower surfaces 2*a* toward an upper surface of the sheet P, thereby forming an image on the sheet P. A separating plate 5 may be configured to separate the sheet P from the outer surface 8*a* of the transport belt 8 when the sheet P is fed to the separating plate 5. The printer 1 may be configured to transport the sheet P upward while the guides 29*a* and 29*b* guide the sheet P and two pairs of transport rollers 28 nip the sheet P. The printer 1 may discharge the sheet P through an opening 30 formed at the top of the housing 1*a* onto the sheet discharge portion 31. Referring to FIG. 12, one roller of each transport roller pair 28 may be driven by a feed motor 128 controlled by the controller 100.

The pretreatment liquid may have one or more of a property of improving a density of ink discharged onto the sheet P, a property of preventing the occurrence of ink blurring or strike-through, e.g., the penetration of ink through the sheet P that is being recorded, and a property of improving color reproduction and a quick dry property of ink, and a property of preventing the occurrence of wrinkles or curls on the sheet P after ink is discharged on the sheet P. For example, liquid containing a polyvalent salt, such as cationic high polymer or a magnesium salt, may be used as the pretreatment liquid. The head 2 for discharging the pretreatment liquid may be disposed upstream from the head 2 for discharging the black ink with respect to the transport direction.

Each head 2 may be a line type head elongated in the primary direction and may have a substantially rectangular parallelepiped shape. The heads 2 may be aligned in the secondary direction with a predetermined pitch and may be supported by the housing 1*a* via a frame 3. A joint may be disposed at an upper surface of each head 2 for receiving a flexible tube. A plurality of discharge nozzles may be formed in the lower surface 2*a* of each head 2. A flow path may be formed inside each head 2 such that liquid, which may be supplied from a corresponding reservoir 42B and 42P of the cartridge 40 via a corresponding tube and a corresponding joint, may flow to corresponding discharge nozzles.

As depicted in FIG. 2, each head 2 may comprise a sealing member 2*c*. The sealing member 2*c* may be an annular member fitted to each head 2 to surround a circumference of the lower surface 2*a* of each head 2. The sealing members 2*c* may be attached to the frame 3 and configured to move up and down with respect to the heads 2, respectively, by a sealing-member up-and-down mechanism 2*c*M, as depicted in FIG. 12. The sealing member 2*c* may be used in a sealing operation.

Figure 4A:
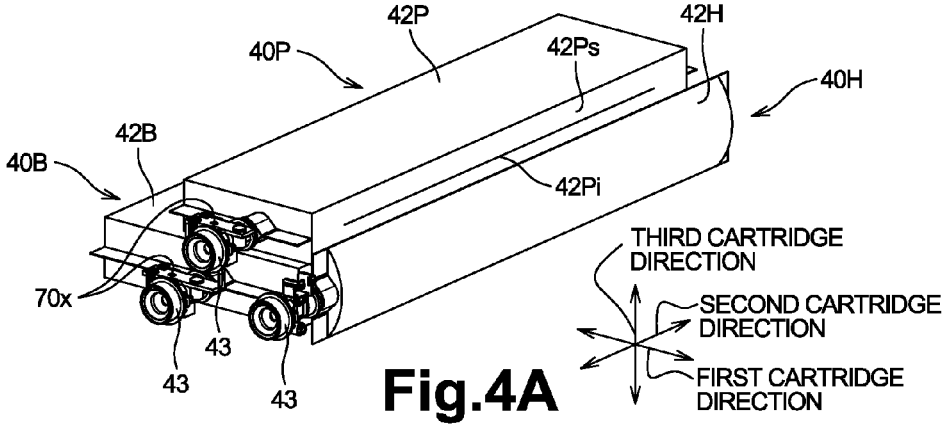
FIG. 4A is a perspective view of a black ink unit, a pretreatment liquid unit, and a humidifying liquid unit contained in a housing of the cartridge of FIG. 3B, in which the housing is removed, according to an embodiment of the invention.
Figure 16:
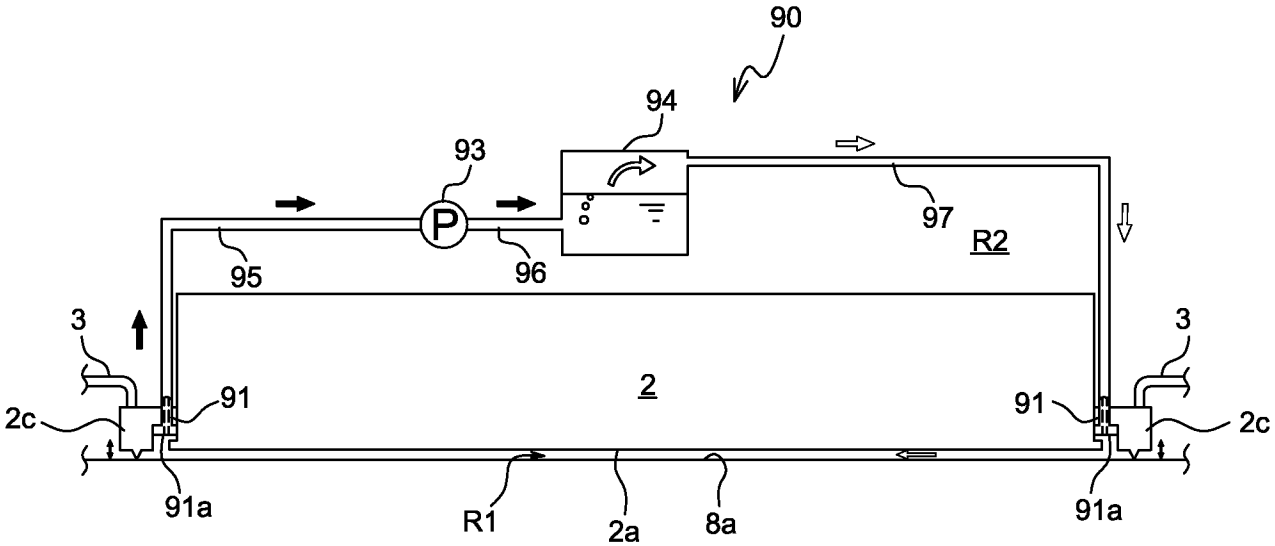
FIG. 16 is a schematic view depicting a humidifying operation performed by a humidifying mechanism according to an embodiment of the invention.

Referring to FIG. 4A, the cartridge 40 may comprise the reservoir 42B for storing black ink, the reservoir 42P for storing pretreatment liquid, and a reservoir 42H for storing humidifying liquid. The black ink stored in the reservoir 42B and the pretreatment liquid stored in the reservoir 42P of the cartridge 40 may be supplied to the respective corresponding heads 2 via respective flexible tubes and joints. The humidifying liquid stored in the reservoir 42H may be supplied to a tank 94, e.g., as depicted in FIG. 16, via a flexible tube. The humidifying liquid may be used in a humidifying operation. For example, the humidifying liquid may comprise water, preservative, and fungicide. The cartridge 40 may be configured to attach to and detach from the housing 1*a* of the printer 1 along the primary direction. Therefore, an empty cartridge 40 may be detached from the housing 1*a* of the printer 1 and a new cartridge 40 may be attached to the housing 1*a* of the printer 1, as a replacement.

As depicted in FIGS. 3A-4D, the cartridge 40 may comprise a housing 41, a black ink unit 40B, a pretreatment liquid unit 40P, a humidifying liquid unit 40H, and a substrate 142. Each of the black ink unit 40B, the pretreatment liquid unit 40P, and the humidifying liquid unit 40H may comprise one of the reservoirs 42B, 42P, and 42H, an ink outlet tube 43, a plug 50, and a valve 60, as depicted in FIGS. 4A-4D, 6A, and 6B. The black ink unit 40B, the pretreatment liquid unit 40P, and the humidifying liquid unit 40H may have substantially the same structure except for their respective sizes.

Figure 6A:
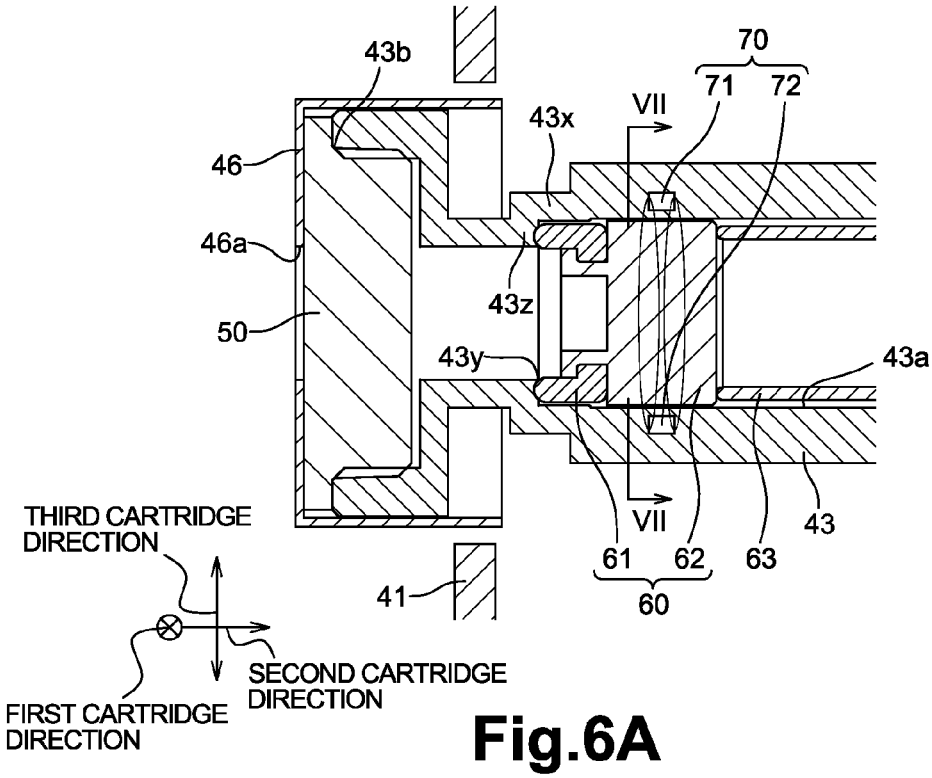
FIG. 6A is a partial cross-sectional view depicting an opening and its surroundings of an ink outlet tube, in which a valve of the cartridge is in a closed position, according to an embodiment of the invention.
Figure 6B:
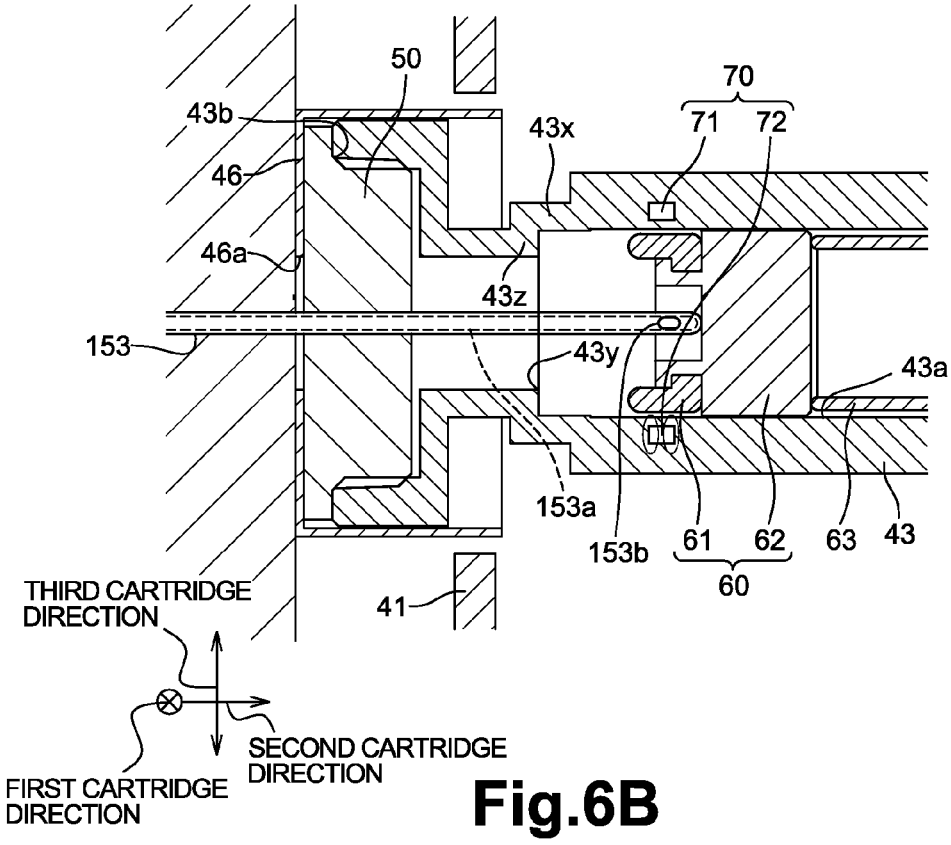
FIG. 6B is a partial cross-sectional view depicting the opening and its surroundings of the ink outlet tube in FIG. 6A, in which the valve of the cartridge is in an open position, according to an embodiment of the invention.

Referring to FIG. 6A, the ink outlet tube 43, e.g., outlet portion, may be fitted in an opening of each reservoir 42B, 42P, and 42H and may define an ink outlet path 43*a* for discharging the liquid stored in the reservoir 42B, 42P, and 42H. As depicted in FIGS. 3B, 6A, and 6B, one end of the ink outlet tube 43 may protrude from the housing 41 of the cartridge 40. The ink outlet tube 43 may have an opening 43*b*, e.g., outlet port, at a side opposite to the reservoir 42B, 42P, and 42H. A plug 50 may comprise an elastomeric material, e.g., rubber, and may be disposed in a compressed state at the one end of the ink outlet tube 43, such that the plug 50 may close the opening 43*b* of the ink outlet path 43*a*, as depicted in FIG. 6A. A cap 46 may be disposed at the one end of the ink outlet tube 43 and outside the plug 50. The cap 46 may have an opening 46*a* formed through its center portion. A surface of the plug 50, which is disposed at a side of the plug 50 opposite from a surface facing the valve 60, may be partially exposed through the opening 46*a*.

Figure 7:
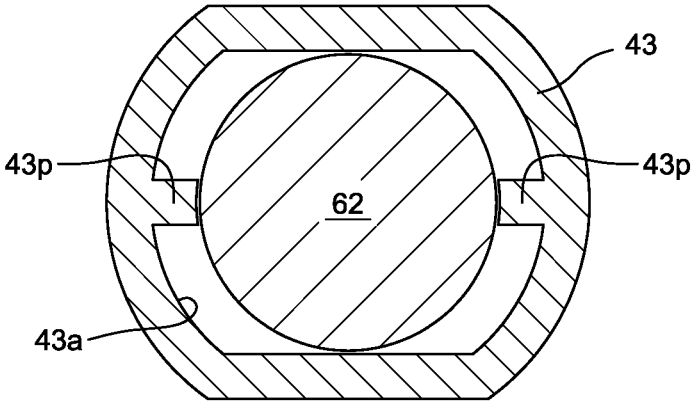
FIG. 7 is a cross-sectional view taken along line VII-VII of FIG. 6A according to an embodiment of the invention.

As depicted in FIG. 6A, the valve 60 may be disposed in the ink outlet path 43*a* and may comprise an O-ring 61 and a valve body 62. As depicted in FIGS. 6A-7, the valve body 62 may be a cylindrical-shaped magnetic body having an axis extending in a second cartridge direction. When the cartridge 40 is mounted in the printer 1, a first cartridge direction may be aligned with the primary direction, the second cartridge direction may be aligned with the secondary direction, and a third cartridge direction, e.g., first direction, may be aligned with the vertical direction. FIG. 7 may depict a cross-sectional view of the ink outlet tube 43 along a plane perpendicular to the second cartridge direction. The ink outlet tube 43 may have a substantially cylindrical-shape. The valve body 62 may be disposed at a portion in the ink outlet tube 43. The portion of the ink outlet tube 43 may comprise flat top and bottom walls and curved side walls. A cross section of the portion of the ink outlet tube 43 may be elongated in the first cartridge direction. Protrusions 43*p* may be disposed at inner surfaces of the respective side walls of the ink outlet tube 43 in the first cartridge direction, such that protrusions 43*p* may protrude toward the inside of the ink outlet tube 43. Each protrusion 43*p* may extend along the second cartridge direction within an area in which the valve body 62 may be movable. The valve body 62 may be held in place by the protrusions 43*p* and the top and bottom walls of the ink outlet tube 43, such that the valve body 62 may be positioned substantially at the center of the ink outlet path 43*a* in the cross-sectional view when valve body 62 moves. A flow path may be formed by the valve body 62 and the ink outlet tube 43 at a space between the valve body 62, the protrusions 43*p* and the top and bottom walls of the ink outlet tube 43.

The O-ring 61 may comprise an elastomeric material, e.g., rubber. The O-ring 61 may be fixed to a surface that may face the plug 50 of the valve body 62. The valve 60 may be urged toward an opening 43*y* of a narrowed portion 43*x* of the ink outlet path 43 by a coil spring 63. One end of the coil spring 63 may be fixed to the other end of the ink outlet tube 43, and the other end of the coil spring 63 may contact the other surface of the valve body 62. As depicted in FIG. 6A, the ink outlet tube 43 may comprise a valve seat 43*z* that may protrude from one end of the narrowed portion 43*x*, e.g., an end disposed near the opening 43*b*, toward the center of the ink outlet tube 43. When the valve 60 is in a closed position, in which the valve 60 closes the ink outlet path 43*a*, the O-ring 61 may contact the valve seat 43*z* to seal the opening 43*y* at the one end of the narrowed portion 43*x* of the ink outlet tube 43. Thus, fluid communication between the reservoir 42B, 42P, and 42H and the outside of the reservoir 42B, 42P, 42H via the ink outlet path 43*a* may be prevented. In this state, the O-ring 61 may be elastically deformed by the biasing force of the coil spring 63.

A sensor unit 70 may be disposed in the ink outlet tube 43 of each of the black ink unit 40B and the pretreatment liquid unit 40P. The sensor unit 70 may comprise the Hall device 71, e.g., Hall effect sensor, and a magnet 72. The magnet 72 may produce a magnetic field. The Hall device 71 may be a magnetic sensor that may be configured to detect a magnetic field of the magnet 72, convert the detected magnetic field to an electric signal, and generate the electric signal. The Hall device 71 may be configured to generate a signal that may indicate a voltage proportioned to the magnetic field magnitude. The magnetic field magnitude may vary in accordance with the movement of the valve body 62. As depicted in FIG. 6A, the Hall device 71 may be disposed at a position where the Hall device 71 may detect the magnetic field produced by the magnet 72 and the valve body 62.

As depicted in FIG. 6A, the Hall device 71 and the magnet 72 may be fixed to the top wall and the bottom wall, respectively, so as to face each other with respect to the third cartridge direction. When the valve 60 is in the closed position, the Hall device 71 and the magnet 72 may face each other while the valve body 62 is positioned therebetween, e.g., the valve body 62 may be positioned between the Hall device 71 and the magnet 72. In this state, the magnetic field produced by the magnet 72 may reach the Hall device 71 via the valve body 62. Accordingly, the Hall device 71 may detect a high magnetic field magnitude and may generate a signal indicating a high voltage. When the valve 60 moves from the closed position, e.g., the position depicted in FIG. 6A, to an open position, e.g., the position depicted in FIG. 6B, at which the valve 60 opens the ink outlet path 43*a*, the magnetic field magnitude detected by the Hall device 71 may decrease in accordance with the movement of the valve body 62, to the position where the valve body 62 may not face the Hall device 71 and the magnet 72 with respect to the third cartridge direction, e.g., the valve body 62 may not be positioned between the Hall device 71 and the magnet 72. Thus, the voltage indicated by a signal generated by the Hall device 71 may become lower. The controller 100 may receive the signal generated by the Hall device 71 and determine whether the valve 60 is in the closed position or in the open position based on a voltage indicated by the signal generated by the Hall device 71. The humidifying liquid unit 40H may not comprise a sensor unit 70 in the ink outlet tube 43.

Figure 3A:
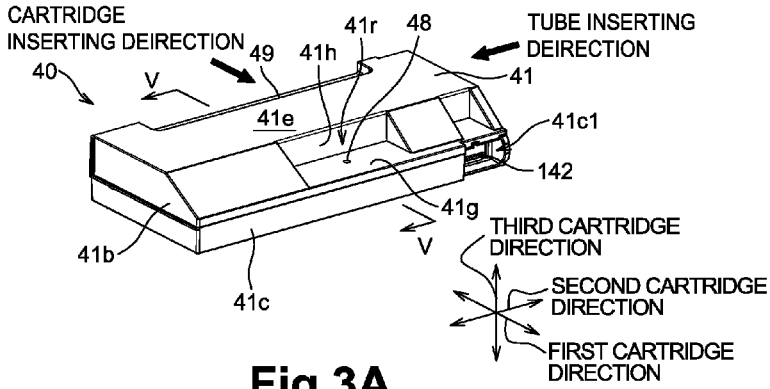
FIG. 3A is a perspective view depicting a particular side of a cartridge according to an embodiment of the invention.
Figure 3B:
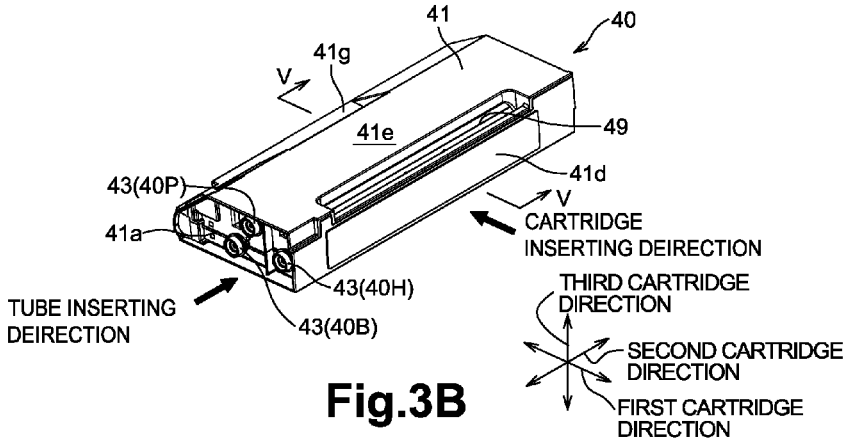
FIG. 3B is a perspective view depicting a further side of the cartridge in FIG. 3A according to an embodiment of the invention.
Figure 3C:
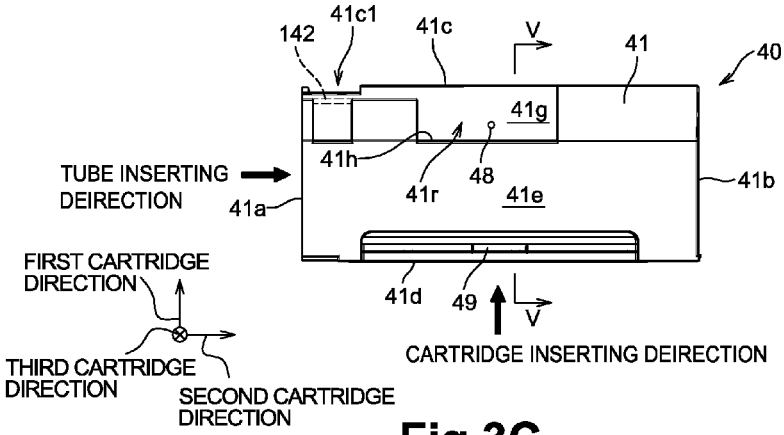
FIG. 3C is a plan view depicting the cartridge in FIG. 3A according to an embodiment of the invention.

As depicted in FIGS. 3A-3C, the housing 41 may have a substantially rectangular parallelepiped shape and may comprise outer surfaces 41*a*-41*h*. The outer surfaces 41*a* and 41*b* may extend substantially parallel to a direction in which the cartridge 40 may be inserted into the space C, e.g., a cartridge inserting direction or a third direction, and spaced apart from each other with respect to a direction in which the hollow tube 153 may be inserted into the ink outlet path 43*a*, e.g., a tube inserting direction. The openings 43*b* of the ink outlet tubes 43 of the reservoirs 42B, 42P, and 42H may be disposed at the outer surface 41*a* of the housing 41, as depicted in FIGS. 6A and 6B. The outer surfaces 41*c* and 41*d* may extend substantially perpendicular to the cartridge inserting direction and substantially parallel to the tube inserting direction. The outer surfaces 41*c* and 41*d* may be disposed between the outer surfaces 41*a* and 41*b* with respect to the tube inserting direction and separated from each other with respect to the cartridge inserting direction. The outer surface 41*c* and 41*d* may respectively be a downstream surface and an upstream surface of the housing 41 with respect the cartridge inserting direction. The outer surfaces 41*e* and 41*f*, as depicted in FIG. 2, may extend substantially perpendicular to the outer surfaces 41*a*-41*d*, respectively, and be disposed between the outer surfaces 41*a* and 41*b* with respect to the tube inserting direction and between the outer surfaces 41*c* and 41*d* with respect to the cartridge inserting direction. The outer surfaces 41*e* and 41*f* may extend substantially parallel to each other and be separated from and opposite to each other with respect to the third cartridge direction. The outer surface 41*g* may extend substantially parallel to the outer surface 41*e* and disposed between the outer surfaces 41*e* and 41*f* with respect to the third cartridge direction and between the outer surfaces 41*e* and 41*c* with respect to the cartridge inserting direction. The outer surface 41*h* may extend between the outer surfaces 41*e* and 41*g* to connect the outer surface 41*e* to the outer surface 41*g* and substantially parallel to the third cartridge direction.

The cartridge inserting direction may be parallel to the first cartridge direction, and the tube inserting direction may be parallel to the second cartridge direction. The cartridge inserting direction may be perpendicular to the tube inserting direction.

Figure 10A:
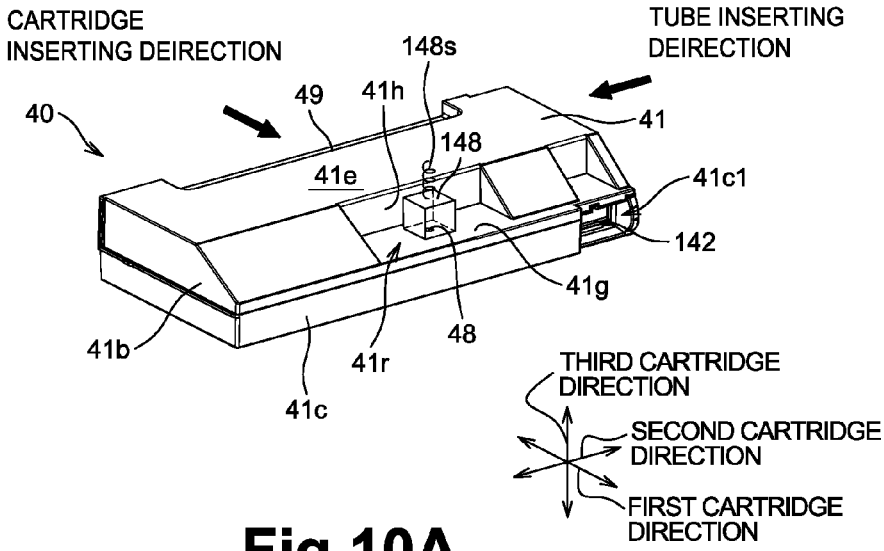
FIG. 10A is a perspective view depicting the cartridge of FIG. 3A during a process of installing the cartridge to the printer according to an embodiment of the invention.
Figure 10B:
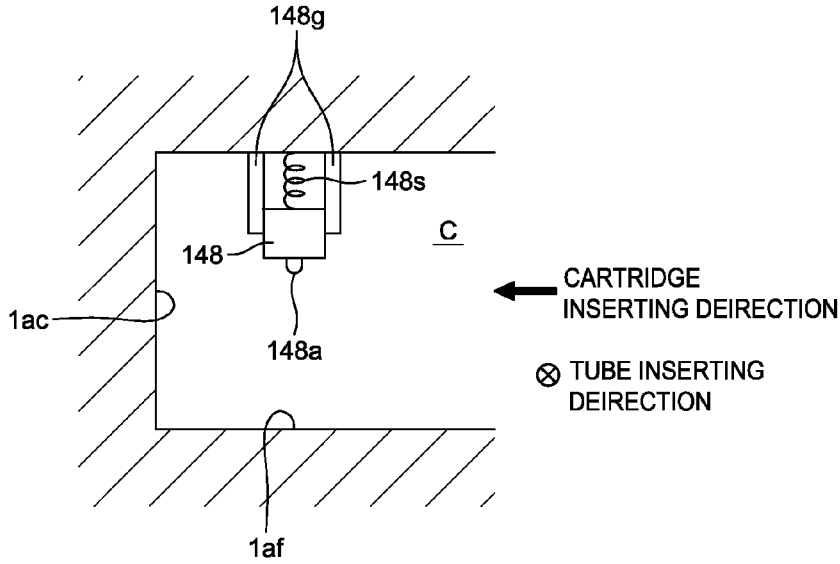
FIG. 10B is a partial cross-sectional view depicting a cartridge receiving portion of the printer according to an embodiment of the invention.

The housing 41 may comprise a hollow 48, e.g., engagement portion, a recessed portion 41*r*, and a hand well portion 49. The hollow 48 may retain the housing 41 of the cartridge 40 in the housing 1*a* of the printer 1 when the cartridge 40 is mounted in the space C. The recessed portion 41*r* may be defined by the outer surfaces 41*g* and 41*h*. The hand well portion 49 may allow the user to hold the cartridge 40. The outer surface 41*g*, e.g., first surface, of the cartridge 40 may have the hollow 48. As depicted in FIG. 10B, the housing 1*a* of the printer 1 may comprise an engagement member 148 comprising a protrusion 148*a*. When the cartridge 40 is inserted into the space C, the protrusion 148*a* of the engagement member 148 may engage the hollow 48 of the cartridge 40. The hand well portion 49 may be disposed in a corner that may be formed by the outer surfaces 41*e* and 41*d* and may comprise a recessed portion that may be elongated along an upstream side of the outer surface 41*e* with respect to the cartridge inserting direction. In the cartridge 40, the hand well portion 49 may be disposed upstream of the hollow 48 and the recessed portion 41*r* with respect to the cartridge inserting direction and may overlap with the hollow 48 and the recessed portion 41*r* with respect to the tube inserting direction.

The outer surface 41*c* may have a recessed portion 41*c*1 at an upstream part of the outer surface 41*c* with respect to the tube inserting direction. The substrate 142 may be disposed inside the recessed portion 41*c*1.

Figure 8:
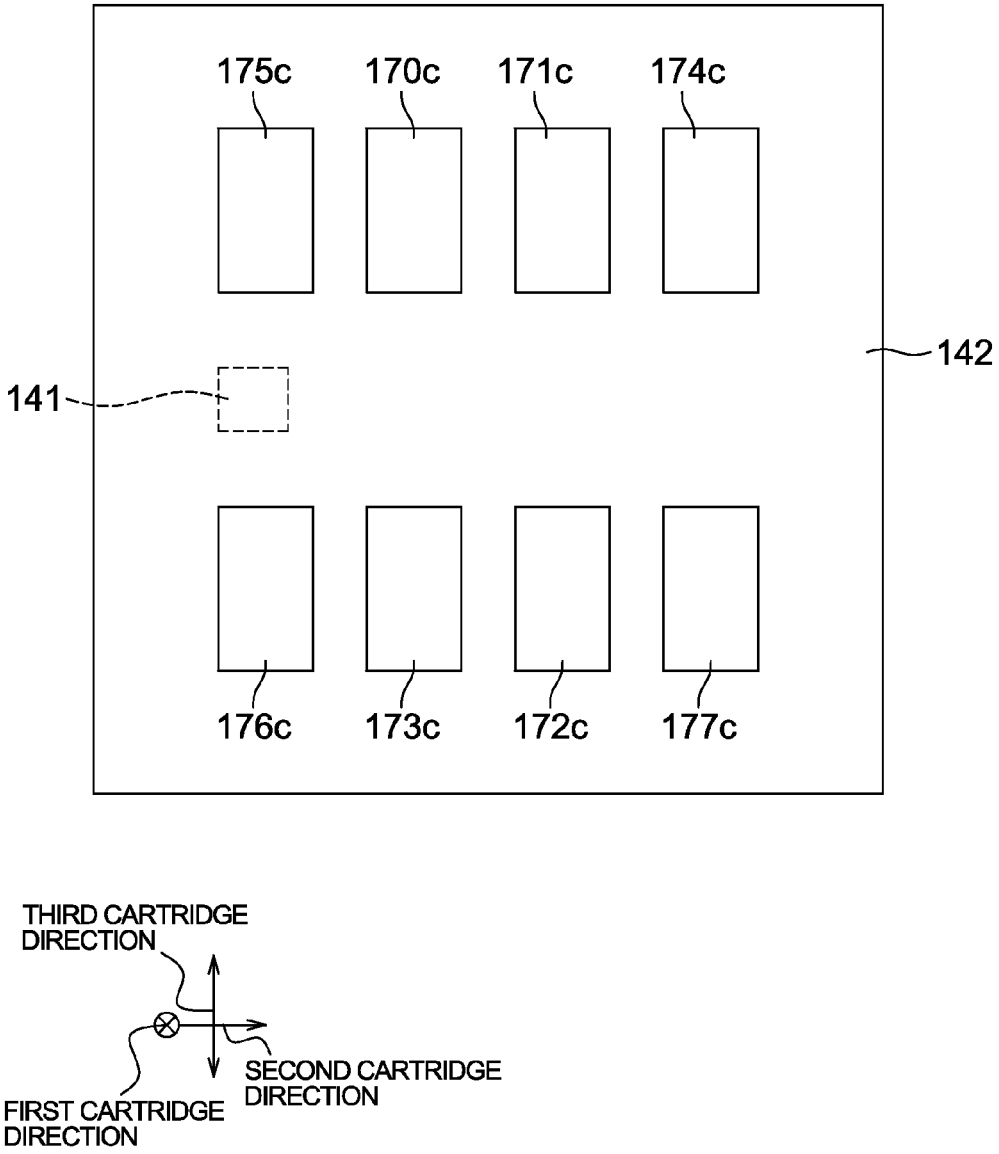
FIG. 8 is a plan view of a substrate of the cartridge when viewed from a direction opposite to a cartridge inserting direction according to an embodiment of the invention.

The substrate 142 may comprise the memory 141 on one surface thereof and a plurality of, e.g., eight, terminals 170*c*-177*c* on the other surface thereof, as depicted in FIG. 8.

The terminals 170*c*-177*c* may be exposed to the outside of the cartridge 40 via the recessed portion 41*c*1. The terminals 170*c*-177*c* may have substantially the same size and shape and may be exposed at the outer surface 41*c* of the cartridge 40. A shape of each of the terminals 170*c*-177*c* may be substantially rectangular including two shorter sides extending in a direction parallel to the second cartridge direction and two longer sides extending in a direction parallel to the third cartridge direction. The terminals 170*c*-177*c* may be arranged in a plurality of rows, e.g., two rows.

Figure 4B:
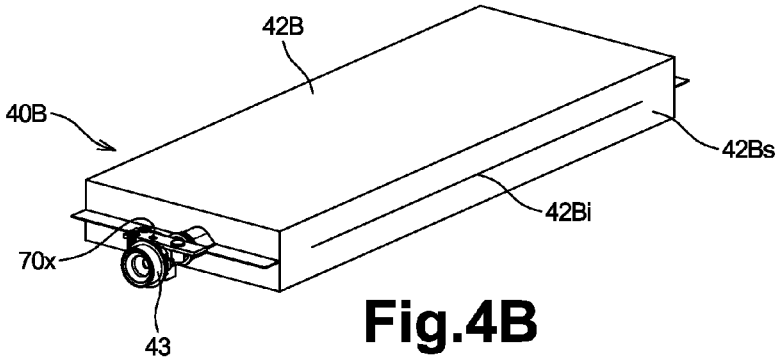
FIG. 4B is a perspective view depicting a black ink unit according to an embodiment of the invention.
Figure 4C:
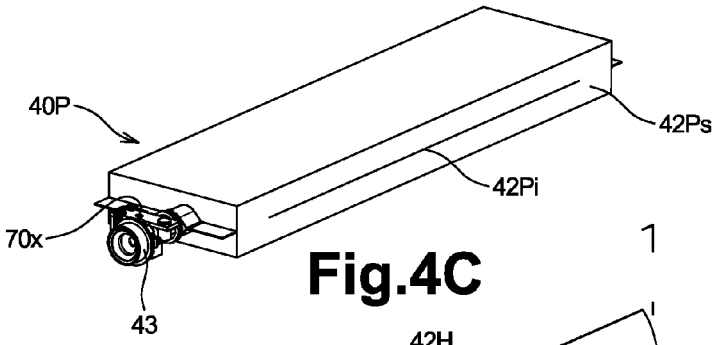
FIG. 4C is a perspective view depicting a pretreatment liquid unit according to an embodiment of the invention.
Figure 4D:
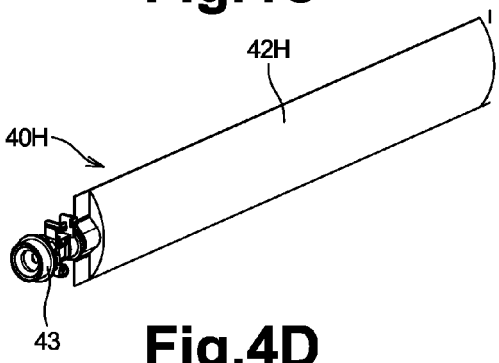
FIG. 4D is a perspective view depicting a humidifying liquid unit according to an embodiment of the invention.

As depicted in FIG. 12, the sensor signal output terminal (SB) 170*c* may be electrically connected with the Hall sensor 71 of the black ink unit 40B. The sensor signal output terminal (SP) 171*c* may be electrically connected with the Hall device 71 of the pretreatment liquid unit 40P. The data output terminal (DO) 172*c* and the data input terminal (DI) 173*c* may be electrically connected to the memory 141. The electric power input terminal (V) 174*p* may be electrically connected with the two Hall devices 71 and the memory 141. The ground terminals (G) 175*c*, 176*c*, and 177*c* may be electrically connected with the memory 141, the Hall device 71 of the pretreatment liquid unit 40P, and the Hall device 71 of the black ink unit 40B, respectively. Electrical connections between the terminals 170*c*, 171*c*, 174*c*, 175*c*, 176*c*, and 177*c* and the respective Hall devices 71 may be established by wiring using flexible cables. As depicted in FIGS. 4B and 4C, a plate 70*x* may be fixed to the ink outlet tube 43 of each of the pretreatment liquid unit 40P and the black ink unit 40B. The flexible cables may be attached to the plate 70*x*, respectively. Electrical connections between the terminals 172*c*, 173*c*, 174*c*, 175*c*, 176*c*, and 177*c* and the memory 141 may be established via conductive members that may be filled in through holes formed in the substrate 142.

The memory 141 may comprise an electrically erasable programmable ROM ("EEPROM") or the like, and may store data relating to the cartridge 40. More specifically, the memory 141 may prestore an amount of liquid remaining in each reservoir 42B and 42P, and sensor output values, e.g., output values Vmax and Vmin received from each Hall device 71. The controller 100 may be configured to read data from the memory 141 while the cartridge 40 is mounted in the space C of the printer 1. In addition, while the cartridge 40 is mounted in the printer 1, the controller 100 may be configured to write data in the memory 141, e.g., the amount of liquid remaining in each reservoir 42B and 42P.

As depicted in FIGS. 4A-4D, each reservoir 42B, 42P, and 42H may comprise a bag that may comprise two sheets. The two sheets may overlay each other and the ink outlet tube 43 may be sandwiched therebetween. Edges of the sheets may be adhered to each other by heat. The reservoir 42B, e.g., first reservoir, may comprise two surfaces 42Bs that may extend in a direction perpendicular to a direction in which an edge, to which the ink outlet tube 43 is attached, extends. Each surfaces 42Bs may have a crease line 42Bi formed therein. Therefore, the reservoir 42B may fold inward at the crease lines 42Bi as the amount of liquid stored in the reservoir 42B decreases. The reservoir 42P, e.g., second reservoir, may also comprise two surfaces 42Ps that may extend in a direction perpendicular to a direction in which an edge, to which the ink outlet tube 43 is attached, extends. Each surface 42Ps may have a crease line 42Pi formed therein. Therefore, the reservoir 42P may fold inward at the crease lines 42Pi as the amount of liquid stored in the reservoir 42P decreases. The reservoir 42H, e.g., third reservoir, may also have surfaces that may extend in a direction perpendicular to a direction in which an edge, to which the ink outlet tube 43 is attached, extends. In another embodiment, the reservoir 42H may not fold inward as the amount of liquid stored in the reservoir 42H decreases.

Figure 5:
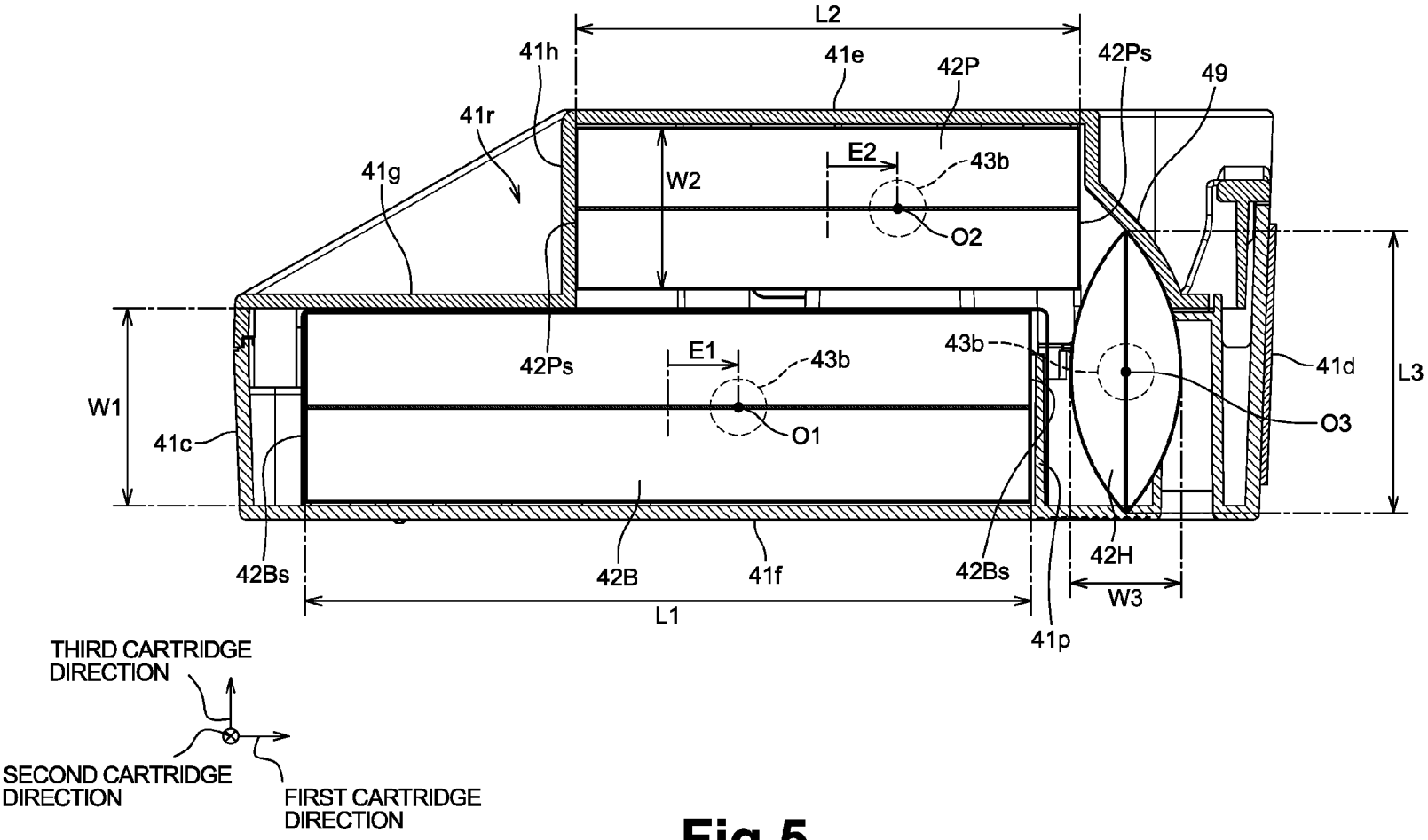
FIG. 5 is a cross-sectional view taken along line V-V of FIGS. 3A, 3B, and 3C according to an embodiment of the invention.

As depicted in FIG. 5, each reservoir 42B, 42P, and 42H may have a narrow, elongated shape in cross section viewed in a direction that the liquid is discharged from the ink outlet tube 43 of each reservoir 42B, 42P, and 42H, e.g., a discharge direction. The cross section of each reservoir 42B and 42P may have substantially a rectangular shape and the cross section of the reservoir 42H may have substantially an ellipse shape.

A relationship among lengths of longer sides of the cross sections of the reservoirs 42B, 42P, and 42H may satisfy L1>L2>L3, where L1 may represent a length of the longer side of the cross section of the reservoir 42B, L2 may represent a length of the longer side of the cross section of the reservoir 42P, and L3 may represent a length of the longer side of the cross section of the reservoir 42H. A relationship among lengths of shorter sides of the cross sections of the reservoirs 42B, 42P, 42H may satisfy W1>W2>W3, where W1 may represent a length of the shorter side of the cross section of the reservoir 42B, W2 may represent a length of the shorter side of the cross section of the reservoir 42P, and W3 may represent a length of the shorter side of the cross section of the reservoir 42H. The length L3 of the longer side of the cross section of the reservoir 42H may be less than a sum of the lengths W1, W2, and W3 of the shorter sides of the cross sections of the reservoirs 42B, 42P, and 42H and less than or equal to a sum of the lengths W1 and W2 of the shorter sides of the cross sections of the reservoirs 42B and 42P. Thus, the relationship of L3≤(W1+W2)<(W1+W2+W3) may be satisfied. The reservoirs 42B, 42P, and 42H may have the substantially same length with respect to the discharge direction.

A relationship among capacities of the reservoirs 42B, 42P, and 42H may satisfy C1>C2>C3, where C1 may represent a capacity of the reservoir 42B, C2 may represent a capacity of the reservoir 42P, and C3 may represent a capacity of the reservoir 42H. A relationship among amounts of liquid stored in the respective reservoirs 42B, 42P, and 42H, e.g., a liquid storage amount, may satisfy V1>V2>V3, where V1 may be an amount of black ink, e.g., first liquid, stored in the reservoir, 42B, V2 may be an amount of pretreatment liquid, e.g., second liquid, stored in the reservoir 42P, and V3 may be an amount of humidifying liquid, e.g., third liquid, stored in the reservoir 42H.

The reservoirs 42B, 42P, and 42H may be disposed such that the discharge directions in the respective reservoirs 42B, 42P, and 42H may be parallel to each other. The discharge directions, e.g., second direction, in the respective reservoirs 42B, 42P, and 42H may be opposite to the tube inserting direction, as depicted in FIG. 3B, parallel to the second cartridge direction, and perpendicular to the first cartridge direction.

As depicted in FIG. 5, the reservoirs 42B and 42P may be disposed side by side with respect to the third cartridge direction while their longer sides of the cross sections may extend parallel to the first cartridge direction and their shorter sides of the cross sections may extend parallel to the third cartridge direction. The reservoir 42H may be disposed such that its longer side of the cross section may extend parallel to the third cartridge direction and its shorter side of the cross section may extend parallel to the first cartridge direction. The reservoir 42H may be disposed adjacent to the reservoirs 42B and 42P with respect to the first cartridge direction.

One of the surfaces 42Ps of the reservoir 42P, which faces the reservoir 42H, e.g., the right surface 42Ps of the reservoir 42P in FIG. 5, may be disposed closer to the reservoir 42H than one surface 42Bs of the reservoir 42B that faces the reservoir 42H, e.g., the right surface 42Bs of the reservoir 42B in FIG. 5, with respect to the first cartridge direction. The reservoirs 42P and 42H may partially overlap each other when viewed in the third cartridge direction.

As depicted in FIG. 5, when viewed in a direction parallel to the discharge direction, e.g., the second cartridge direction, a center O1 of the opening 43*b* communicating with the reservoir 42B may be disposed closer to the reservoir 42H than a center of the reservoir 42B with respect to the first cartridge direction. A center O2 of the opening 43*b* communicating with the reservoir 42P may be disposed closer to the reservoir 42H than a center of the reservoir 42P with respect to the first cartridge direction. That is, the center O1 of the opening 43*b* communicating with the reservoir 42B may be offset from the center toward the reservoir 42H, e.g., toward the right in FIG. 5, by a distance E1 from the center of the reservoir 42B with respect to the first cartridge direction, and the center O2 of the opening 43*b* communicating with the reservoir 42P may be offset from the center toward the reservoir 42H, e.g., toward the right in FIG. 5, by a distance E2 from the center of the reservoir 42P with respect to the first cartridge direction. A center O3 of the opening 43*b* communicating with the reservoir 42H may be disposed between the centers O1 and O2 with respect to the third cartridge direction.

The hand well portion 49 may be disposed in a recessed portion that may face the reservoir 42P with respect to the first cartridge direction and the reservoir 42H with respect to the third cartridge direction, e.g., the hand well portion 49 may be disposed on the right side of the reservoir 42P and above the reservoir 42H, as depicted in FIG. 5. One or more of walls defining the hand well portion 49 may be configured to hold the reservoirs 42P and 42H.

The recessed portion 41*r* may face the reservoir 42P with respect to the first cartridge direction and face the reservoir 42B with respect to the third cartridge direction, e.g., the recessed portion 41*r* may be defined at the left of the reservoir 42P and above the reservoir 42B in FIG. 5. The outer surface 41*g* defining the recessed portion 41*r* may have the hollow 48, as depicted in FIG. 3A. One or more of walls defining the recessed portion 41*r*, e.g., outer surfaces 41*g* and 41*h*, may be configured to hold the reservoirs 42B and 42P.

A partition 41*p* may be disposed between the reservoirs 42B and 42H. The partition 41*p* may protrude along the third cartridge direction from a lower wall of the housing 41 of the cartridge 40 and an upper edge of the partition 41*p* may be disposed lower than an upper surface of the reservoir 42B. The partition 41*p* may not contact the reservoir 42P when viewed in the first cartridge direction.

The above shape and size of the cross section of each reservoir 42B, 42P, and 42H, the liquid storage amount V1, V2, and V3 of each reservoir 42B, 42P, 42H, and the like may be applied to a new cartridge 40, e.g., a cartridge 40 which has not been used and which has the same amount of liquid stored in each reservoir 42B, 42P, and 42H as when the cartridge 40 was assembled, and each reservoir 42B, 42P, and 42H may be full of liquid. The liquid storage amount V1, V2, and V3 may be reduced and the shape and size of the cross section of each reservoir 42B, 42P, and 42H may be changed in accordance with consumption of liquid stored in each reservoir 42B, 42P, and 42H when the cartridge 40 is used. For example, the cross section of each reservoir 42B, 42P, and 42H may become further flattened, e.g., the length W1, W2, and W3 of the shorter side of each reservoir 42B, 42P, and 42H may decrease. As a result, one or more of the relationship of $L3 \leq (W1+W2)$, the relationship of $L3 < (W1+W2+W3)$ and the relationship of $V1 > V2 > V3$ may no longer be satisfied. In addition, the consumption of liquid may cause one or more situations in which the reservoirs 42P and 42H may not partially overlap each other when viewed in the third cartridge direction, the one or more of the walls defining the hand well portion 49 may not hold one or both of the reservoirs 42P and 42H, the one or more of the walls defining the recessed portion 41*r* may not hold one or both of the reservoirs 42B and 42P, and the upper edge of the partition 41*p* may be disposed higher than or at the same level as the upper surface of the reservoir 42B.

Referring to FIGS. 2 and 9A-9C, the space C may be defined by walls of the housing 1*a* of the printer 1. The walls of the housing 1*a* may comprise walls 1*aa*, 1*ab*, 1*ac*, and 1*af*. The walls 1*aa* and 1*ab* may extend substantially parallel to the cartridge inserting direction and be separated from each other with respect to the tube inserting direction. A support member 154 may be disposed on the wall 1*aa*. The support member 154 may be configured to hold a plurality of hollow tubes 153, e.g., three hollow tubes 153, corresponding to the black ink unit 40B, the pretreatment liquid unit 40P, and the humidifying liquid unit 40H, respectively. The support member 154 may be further configured to be movable in the tube inserting direction and in the direction opposite to the tube inserting direction with respect to the housing 1*a* of the printer 1 by a moving mechanism 155, as depicted in FIG. 12. The hollow tubes 153 may be configured to be located selectively in a removed position, as depicted in FIG. 6A, and an inserted position, as depicted in FIG. 6B, in accordance with the movement of the support member 154. When the hollow tubes 153 are located in the removed position, the hollow tubes 153 may be removed from the respective ink outlet paths 43*a* of the reservoirs 42B, 42P, and 42H. When the hollow tubes 153 are located in the inserted position, the hollow tubes 153 may be inserted into the respective ink outlet paths 43*a* of the reservoirs 42B, 42P, 42H. The hollow tubes 153 corresponding to the black ink unit 40B and the pretreatment liquid unit 40P, respectively, may be in fluid communication with the head 2 for discharging the black ink and the head 2 for discharging the pretreatment liquid, respectively, via respective flexible tubes and respective joints. The hollow tube 153 corresponding to the humidifying liquid unit 40H may be in fluid communication with the tank 94, as depicted in FIG. 16, via the flexible tube.

The wall 1*ac* may extend substantially parallel to the cartridge inserting direction and define a downstream-side surface of the cartridge 40 with respect to the cartridge inserting direction. The wall 1*ac* may be disposed between the walls 1*aa* and 1*ab* with respect to the tube inserting direction. A substrate 182 may be disposed on the wall 1*ac*.

The wall 1*af* may extend substantially perpendicular to the walls 1*aa*, 1*ab*, and 1*ac*, and define the lower surface of the space C. The wall 1*af* may have a recessed portion 1*afx*, as depicted in FIG. 2, in an upstream end portion with respect to the cartridge inserting direction. The recessed portion 1*afx* of the wall 1*af* may allow the user to insert his/her hand, which is holding the hand well portion 49 of the cartridge 40, into the space C.

Figure 9A:
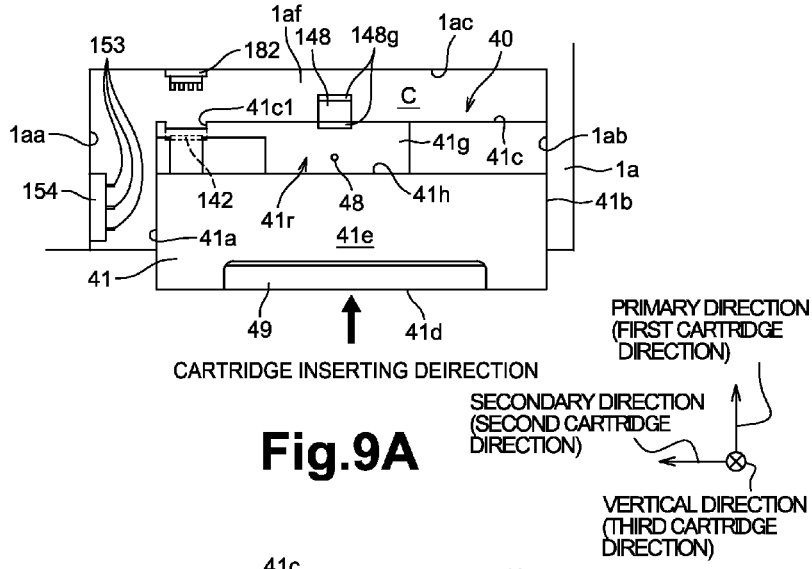
FIG. 9A is a schematic plan view depicting a process of installing the cartridge to the printer according to an embodiment of the invention.
Figure 11A:
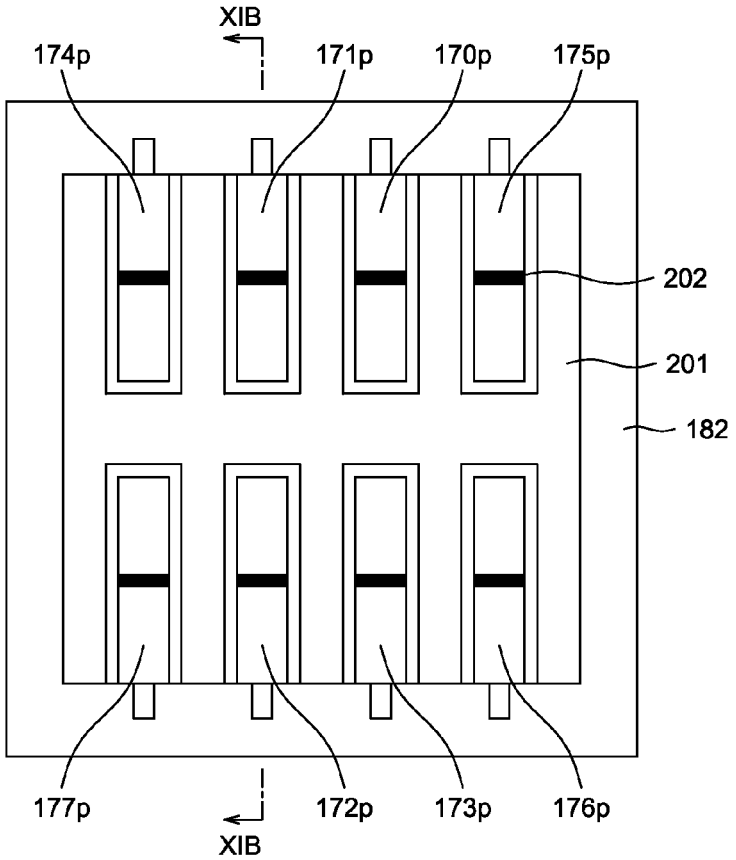
FIG. 11A is a plan view depicting a substrate of the main unit of the printer when viewed in the cartridge inserting direction according to an embodiment the invention.
Figure 11B:
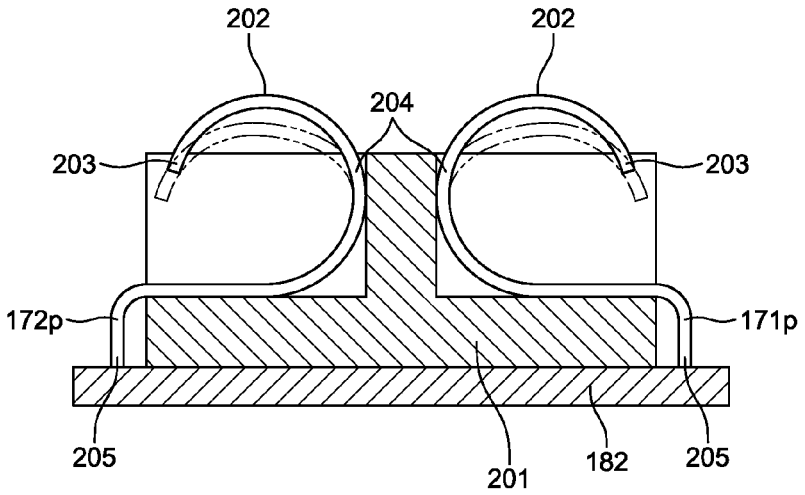
FIG. 11B is a cross-sectional view taken along line XIB-XIB of FIG. 11A according to an embodiment of the invention.

The substrate 182 may have substantially the same size as the substrate 142. The substrate 182 may be disposed to face the substrate 142 of the cartridge 40 when the cartridge 40 is installed in the space C, as depicted in FIG. 9A. As depicted in FIGS. 11A and 11B, a base material 201 may be disposed on a surface of the substrate 182. A plurality of terminals 170*p*-177*p*, e.g., eight terminals 170*p*-177*p*, may be provided on a surface of the base material 201, such that the terminals 170*p*-177*p* may correspond to the terminals 170*c*-170*c*, respectively.

As depicted in FIG. 11B, each of the terminals 170*p*-177*p* may comprise a leaf spring having a substantially C-shape in cross section, and may have a first end 205, a second end 203, and a top portion 202. In each of the terminals 170*p*-177*p*, the first end 205 may be a fixed end that may be fixed to the substrate 182 to establish electric connections therebetween and the second end 203 may be a free end that may bend at a portion 204. When the second end 203 is urged in the primary direction, the second end 203 may exert its urging force in a direction opposite to the cartridge inserting direction, e.g., an upward direction in FIG. 11B.

The terminals 170*p*-177*p* may be arranged in a mirror image of the terminals 170*c*-177*c*, such that each of the terminals 170*p*-177*p* may contact one of the terminals 170*c*-177*c*, respectively, when the cartridge 40 is installed in the space C.

As depicted in FIG. 12, the sensor signal receiving terminal (SB) 170*p*, the sensor signal receiving terminal (SP) 171*p*, the data receiving terminal (DO) 172*p*, and the data transmitting terminal (DI) 173*p* may be electrically connected with the controller 100. The electric power output terminal (V) 174*p* may be electrically connected with a power supply 158 provided in the housing 1*a*. The ground terminals 175*p*, 176*p*, and 177*p* may be grounded.

Referring to FIGS. 9A-15, the cartridge 40 may be installed into the space C of the printer 1 and may establish fluid communication between the black ink unit 40B and the corresponding head 2, between the pretreatment liquid unit 40P and the corresponding head 2, and between the humidifying liquid unit 40H and the tank 94. In FIG. 12, electric power supply lines may be indicated by thick lines and signal lines may be indicated by thin lines.

For installation of the cartridge 40 into the space C of the housing 1*a* of the printer 1, first, the user of the printer 1 may open the cover 1*c* of the printer 1, as depicted in FIG. 1. Then, the user may hold the hand well portion 49 of the cartridge 40 with one hand and insert the cartridge 40 into the space C while placing his/her four fingers other than a thumb in the recessed portion 1*afx* of the printer 1. Thus, the user may move the cartridge 40 along the cartridge inserting direction to install the cartridge 40 in the space C, as depicted in FIG. 9A. Accordingly, the cartridge 40 may be inserted to a predetermined position in the space C, as depicted in FIG. 9B.

Figure 9B:
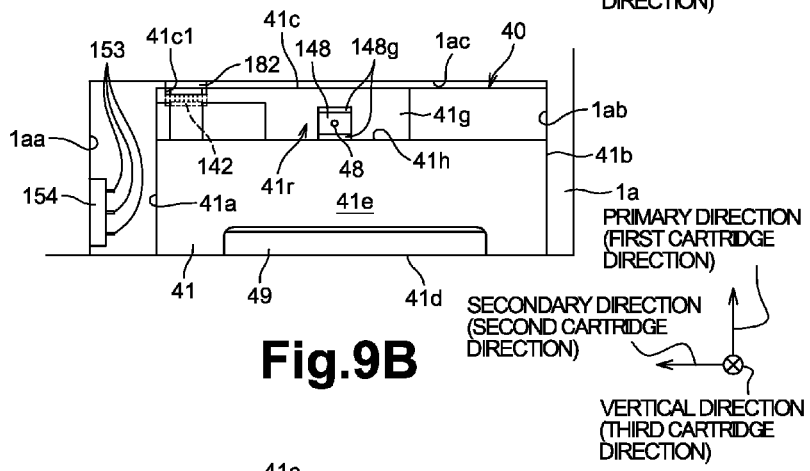
FIG. 9B is another schematic plan view depicting the process of installing the cartridge to the printer according to an embodiment of the invention.
Figure 9C:
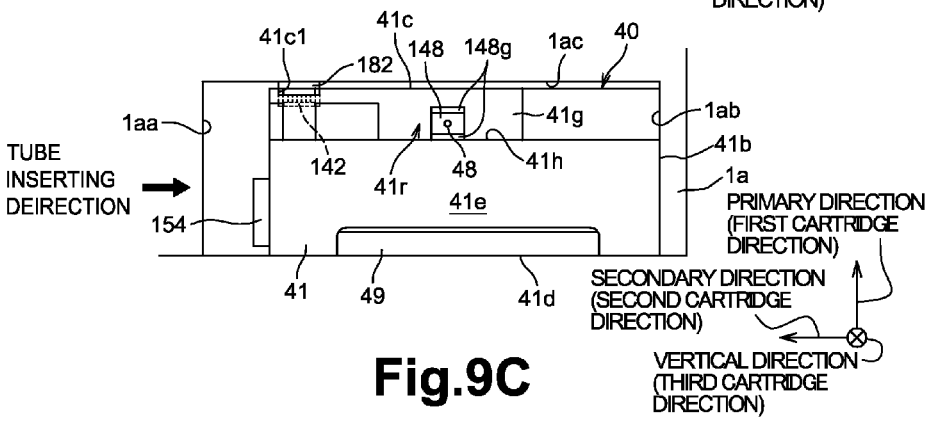
FIG. 9C is still another schematic plan view depicting the process of installing the cartridge to the printer according to an embodiment of the invention.

In a process of installing the cartridge 40 in the predetermined position depicted in FIG. 9B, the substrate 182 of the housing 1*a* may enter the recessed portion 41*c*1 of the cartridge 40 and may contact the substrate 142 of the cartridge 40, such that the terminals 170*c*-177*c* of the cartridge 40 may contact the corresponding terminals 170*p*-177*p* of the printer 1. The terminals 170*c*-177*c* may press the corresponding terminals 170*p*-177*p* to change states of the terminals 170*p*-177*p* and the second ends 203 of the terminals 170*p*-177*p* may bend downward at portions 204. Therefore, the states of the terminals 170*p*-177*p* may be changed from a state indicated in a solid line to a state indicated in a dashed line, as depicted in FIG. 11B. As described above, the centers of the terminals 170*c*-177*c* may contact the top portions 202 of the corresponding terminals 170*p*-177*p* to establish electrical connections therebetween. Thus, the electric power may be supplied from the power supply 158 to the Hall devices 71 and the memory 141 via the terminals 174*p* and 174*c*. Further, the controller 100 may receive signals from the Hall device 71 of the black ink unit 40B via the terminals 170*c* and 170*p*, receive signals from the Hall device 71 of the pretreatment liquid unit 40P via the terminals 171*c* and 171*p*, read data from the memory 141 via the terminals 172*c* and 172*p*, and write data into the memory 141 via the terminals 173*c* and 173*p*.

Because the cartridge 40 is disposed in the predetermined position, as depicted in FIG. 9B, the protrusion 148*a* of the engagement member 148 of the housing 1*a*, as depicted in FIG. 10B, may be engaged in the hollow 48 of the cartridge 40 and the housing 41 of the cartridge 40 may be retained securely. As depicted in FIG. 10B, the engagement member 148 may be attached to a wall defining an upper surface of the space C via a spring 148*s*. The engagement member 148 may be urged downward by the spring 148*s*. The protrusion 148*a* may protrude downward from a lower surface of the engagement member 148. The engagement member 148 may be held by a pair of guide walls 148*g* with respect to the primary direction so as not to move along the primary direction. The pair of guide walls 148*g* may be fixed to the wall defining the upper wall of the space C. In the process of installing the cartridge 40 in the predetermined position, as depicted in FIG. 9B, the engagement member 148 may be disposed in the recessed portion 41*r* of the cartridge 40 and the protrusion 148*a* may contact the outer surface 41*g* of the cartridge 40. The protrusion 148*a* then may slide over the outer surface 41*g* while contacting the outer surface 41*g*. A lower surface of the engagement member 148 may be disposed slightly higher than the outer surface 41*g*, such that the spring 148*s* may not contract until the protrusion 148*a* contacts the outer surface 41*g*. When the protrusion 148*a* contacts the outer surface 41*g*, the spring 148*s* may contract and thus the engagement member 148 may be moved upward slightly. When the cartridge 40 is disposed in the predetermined position, as depicted in FIG. 9B, the engagement member 148 may be moved downward by an urging force of the spring 148*s* and the protrusion 148*a* may be engaged in the hollow 48 of the cartridge 40. Accordingly, an upstream guide wall 148*g* of the pair of guide walls 148*g* with respect to the cartridge inserting direction may contact the outer surface 41*h* of the cartridge 40. An upper surface of the engagement member 148, e.g., a surface to which the spring 148*s* may be attached, may be disposed lower than the outer surface 41*e* while the cartridge 40 is inserted into the space C and while the cartridge 40 is mounted in the space C.

After the cartridge 40 is mounted in the predetermined position, as depicted in FIG. 9B, an installation detection switch 159, as depicted in FIG. 12, may output an ON signal as the cover 1*c*, as depicted in FIG. 1, is closed. Upon receipt of the ON signal, the controller 100 may determine that the cartridge 40 has been installed in the predetermined position in the space C, e.g., "YES" at step S1 in FIG. 14.

The installation detection switch 159 may comprise a protrusion at a wall having the opening 10*c*, as depicted in FIG. 1, in the housing 1*a*. The protrusion may protrude from the wall when the cover 1*c* is opened and may retract into the wall by the cover 1*c* when the cover 1*c* is closed. The installation detection switch 159 may be configured to output OFF signals when the protrusion protrudes from the wall and ON signals when the protrusion retracts in the wall.

When the controller 100 determines that the cartridge 40 has been installed in the predetermined position in the space C, e.g., "YES" at step S1, then at step S2, the controller 100 may read, from the memory 141 of the cartridge 40, e.g., the data of the amount of liquid remaining in each reservoir 42B and 42P and the sensor output values. At step S3, the controller 100 then may control the moving mechanism 155, as depicted in FIG. 12, to move the support member 154 holding the hollow tubes 153 along the tube inserting direction, indicated by a thick arrow in FIG. 9C.

In accordance with the movement of the hollow tubes 153 at step S3, the hollow tubes 153 may penetrate the substantially center portions of the respective plugs 50 of the black ink unit 40B, the pretreatment liquid unit 40P, and the humidifying liquid unit 40H along the primary direction, as depicted in FIG. 6B. Each hollow tube 153 may have an opening 153*b* formed therethrough at its one end. Thus, the opening 153*b* may be positioned in the ink outlet path 43*b*, so that a flow path 153*a* provided in the hollow tube 153 and the ink outlet path 43*a* may be in fluid communication with each other via the opening 153*b*. The plug 50 may be perforated with a hole by the penetration of the hollow tube 153. A portion surrounding the hole of the plug 50 may tightly contact the circumference of the hollow tube 153 by the elasticity of the plug 50. Therefore, leakage of liquid from a gap between the hole of the plug 50 and the hollow tube 153 may be reduced or prevented. A tip of the hollow tube 153 may then contact the valve body 62, and the valve body 62 may move together with the O-ring 61 by the further insertion of the hollow tube 153 into the ink outlet path 43*a*. Thus, the O-ring 61 may be separated from the valve seat 43*z*, as depicted in FIG. 6B, and the valve 60 may transition to the open position from the closed position. When the valve 60 is in the open position, the ink outlet path 43*a* may place the reservoir 42 and the outside of the reservoir 42 in fluid communication. As depicted in FIG. 6B, when the hollow tube 153 penetrates the plug 50 and the valve 60 is in the open position, the reservoir 42B and 42P, the flow path of the head 2, the reservoir 42H, and the tank 94 may be in fluid communication with each other via the ink outlet path 43*a* and the flow path 153*a*.

At step S4, the controller 100 may receive signals from the Hall devices 71 of the black ink unit 40B and the pretreatment liquid unit 40P. At step S5, the controller 100 may determine whether the valves 60 of the black ink unit 40B and the pretreatment liquid unit 40P are in the open positions based on the signals received at step S4 and the output values Vmax and Vmin read from the memory 141 at step S2. The controller 100 may perform the determination at step S5.

Figure 15:
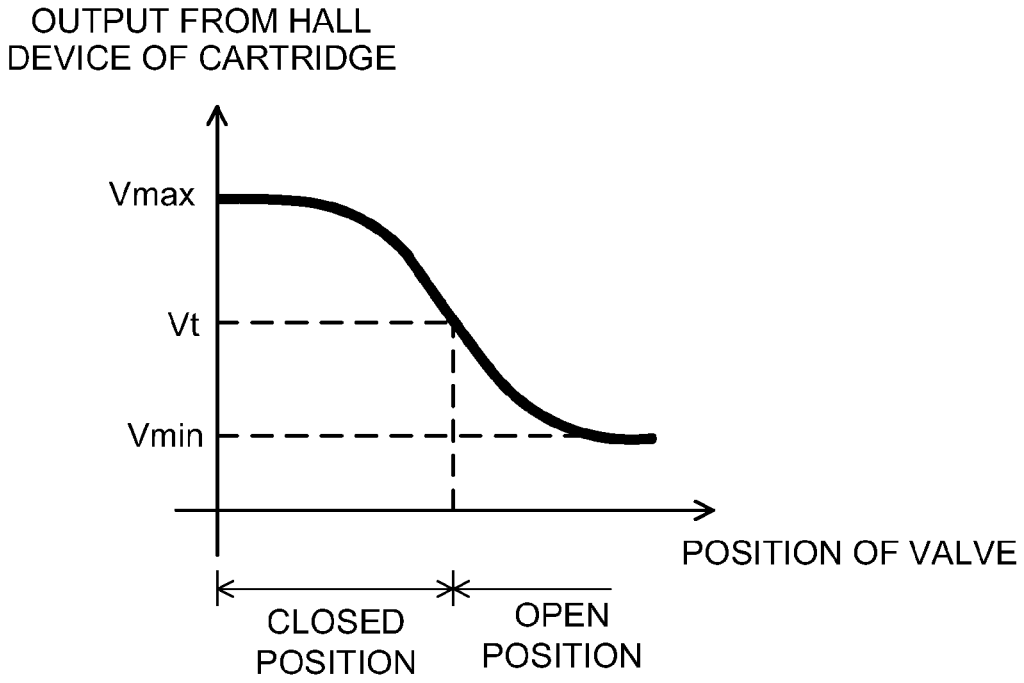
FIG. 15 is a graph depicting a relationship between a position of a valve of a cartridge and an output value from a Hall device of the cartridge according to an embodiment the invention.

Referring to FIG. 15, a relationship between a position of the valve 60 and an output value from the Hall device 71 maybe depicted in a graph. The horizontal axis may represent the position of the valve 60 in the first cartridge direction. The vertical axis may represent output values from the Hall device 71. Vmax may be an output value from the Hall device 71 to which a predetermined drive voltage may be applied when the valve 60 is in the closed position, as depicted in FIG. 6A. Vmin may be an output value from the Hall device 71 to which the predetermined voltage may be applied when the valve 60 is in the open position, as depicted in FIG. 6B. A threshold value Vt may be obtained based on the output values Vmax and Vmin read by the controller 100 at step S2, e.g., Vt=(Vmax+Vmin)/2. When the output value from the Hall device 71 received at step S4 is less than or equal to the threshold value Vt, the controller 100 may determine that the valve 60 is in the open position. When the output value from the Hall device 71 received at step S4 is greater than the threshold value Vt, the controller 100 may determine that the valve 60 is in the closed position.

When a predetermined time has elapsed while the valves 60 of the black ink unit 40B and the pretreatment liquid unit 40P are not in the open positions, e.g., "YES" at step S6, the controller 100 may issue an error notification via an output device, e.g., a display or a speaker of the printer 1 at step S7, and the controller 100 may stop operations of each components of the printer 1 at step S8. The open error may occur due to a faulty Hall device 71 of the black ink unit 40B caused by a short circuit occurred between the terminal 170*c* and the terminal 174*c*, due to a faulty Hall device 71 of the pretreatment liquid unit 40P caused by a short circuit occurred between the terminal 171*c* and the terminal 174*c*, due to a malfunction in communications capabilities of the controller 100 caused by a short circuit occurred between the terminal 173*c* and the terminal 174*c*, or due to a defective condition in one or more of the plugs 50, the valves 60 of the cartridge 40, the hollow tubes 153, and the moving mechanism 155 of the printer 1.

When the controller 100 determines that the valves 60 of the black ink unit 40B and the pretreatment liquid unit 40P are in the open positions, e.g., "YES" at step S5, the controller 100 may determine whether a recording command has been received from the external device at step S9. When the controller 100 determines that the recording command has been received, e.g., "YES" at step S9, the controller 100 may determine whether an amount of black ink and an amount of pretreatment liquid to be used in recording according to the recording command are less than the remaining amount of black ink and the remaining amount of pretreatment liquid, respectively at step S10. The amount of liquid to be used may be an amount of liquid to be discharged during recording according to the recording command and obtained based on image data included in the recording command. The data read from the memory 141 at step S2 may be used to derive the amount of liquid remaining.

When the amount of liquid to be used is greater than or equal to the amount of liquid remaining, e.g., "NO" at step S10, the controller 100 may issue an error notification at step S7 and may stop operations of each components of the printer 1 at step S8.

When the amount of liquid to be used is less than the amount of liquid remaining, e.g., "YES" at step S10, the controller 100 may control the sheet feed motor 125, the transport motor 127, a feed motor 128, and the heads 2 to perform recording on a sheet P at step S11.

After step S11, the controller 100 may write, into the memory 141, the data of the amount of liquid remaining in each reservoir 42B and 42P at step S12. The controller 100 may obtain an amount of liquid currently remaining by subtracting the amount of liquid used obtained at step S10 from the amount of liquid remaining read from the memory 141 at step S2, and may write an update into the memory 141.

After step S12, the controller 100 may return the routine to step S9 and wait until the controller 100 determines that a recording command is received.

For removal of the cartridge 40 from the space C, the user of the printer 1 may first open the cover 1*c*, as depicted in FIG. 1. When the cover 1*c* is opened, the installation detection switch 159 may output an OFF signal. Upon receipt of the OFF signal, the controller 100 may control the moving mechanism 155, as depicted in FIG. 12, to move the support member 154 in a direction opposite to the tube inserting direction. Thus, the support member 154 holding the hollow tubes 153 may move from the position depicted in FIG. 9C to the position depicted in FIG. 9B. In accordance with the leftward movement of the hollow tube 153 in FIG. 6B in each of the black ink unit 40B, the pretreatment liquid unit 40P, and the humidifying liquid unit 40H, the valve 60 also may move leftward in FIG. 6B and may contact the valve seat 43*z* by the urging force of the coil spring 63. Thus, the valve 60 may transition from the open position to the closed position. When the output values received from the Hall device 71 exceed the threshold value Vt in each of the black ink unit 40B and the pretreatment liquid unit 40P, the controller 100 may determine that the valves 60 are in closed positions. The hollow tube 35 may then be removed from the plug 50. The hole formed in the plug 50 by the hollow tube 153 may become smaller by the elasticity of the portion surrounding the hole and may prevent the leakage of liquid from the gap between the hole of the plug 50 and the hollow tube 153.

The user may insert his/her four fingers other than the thumb into the recessed portion 1*afx* of the printer 1 while holding the hand well portion 49 of the cartridge 40 with one hand. The cartridge 40 may be moved along a direction opposite to the cartridge inserting direction. A force may act on the housing 41 in the direction opposite to the cartridge inserting direction. When the force becomes greater than or equal to a predetermined force, the protrusion 148*a* of the engagement member 148 may be removed from the hollow 48. After the protrusion 148*a* is removed from the hollow 48 of the cartridge 40, the cartridge 40 may be moved in the direction opposite to the cartridge inserting direction with relatively smaller force. When the cartridge 40 is removed from the space C, the substrate 142 of the cartridge 40 may be separated from the substrate 182 of the printer 1. Therefore, electrical connections between the terminals 170*c*-177*c* and the corresponding terminals 170*p*-177*p* may be released, and the electric power may not be supplied to the Hall devices 71 and the memory 141. Accordingly, the controller 100 may stop performing further signal transmission and reception with the Hall devices 71 and the memory 141.

Figure 13:
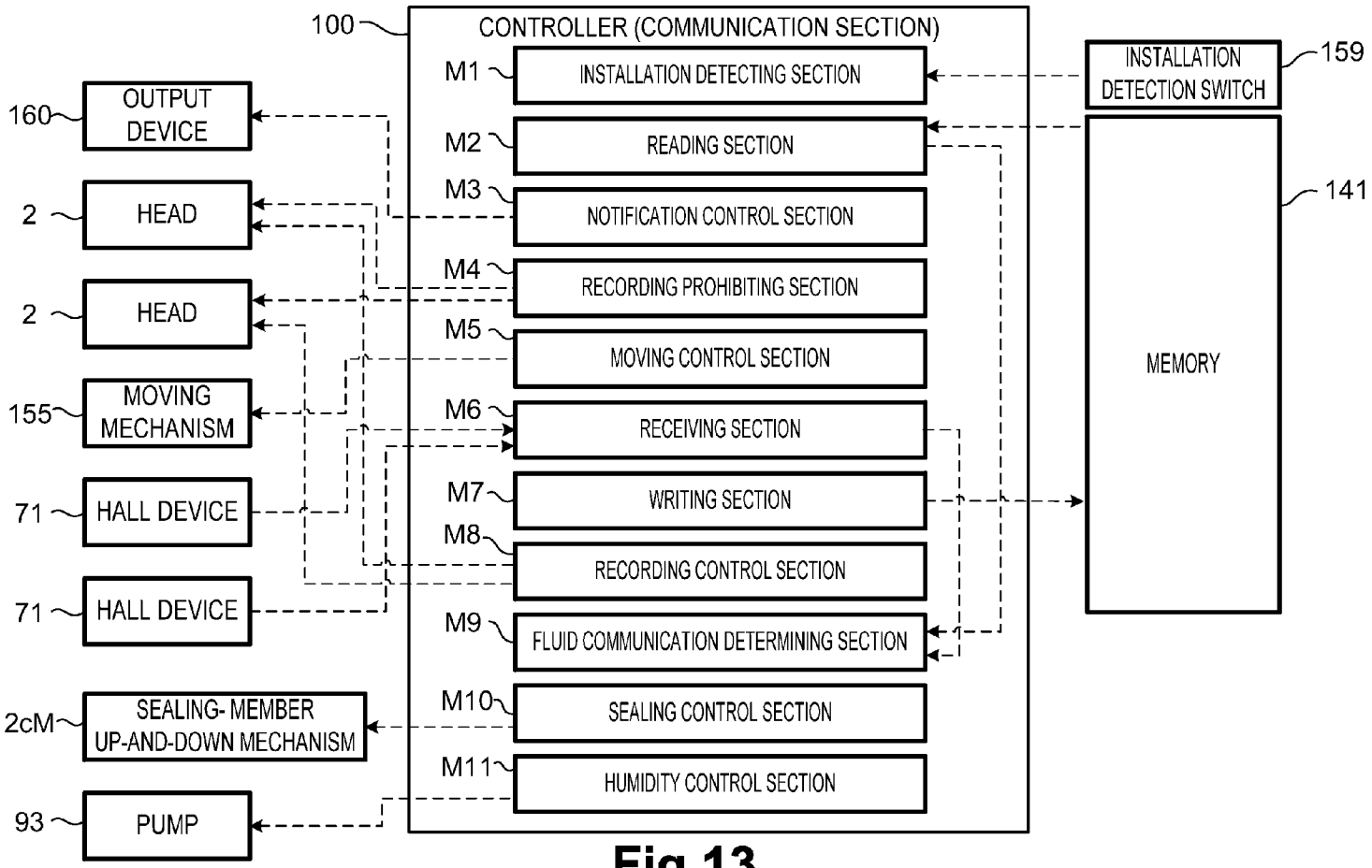
FIG. 13 is a functional block diagram depicting sections embodied by a controller of the printer in the illustrative embodiment according to one or more aspects of the invention.
Figure 14:
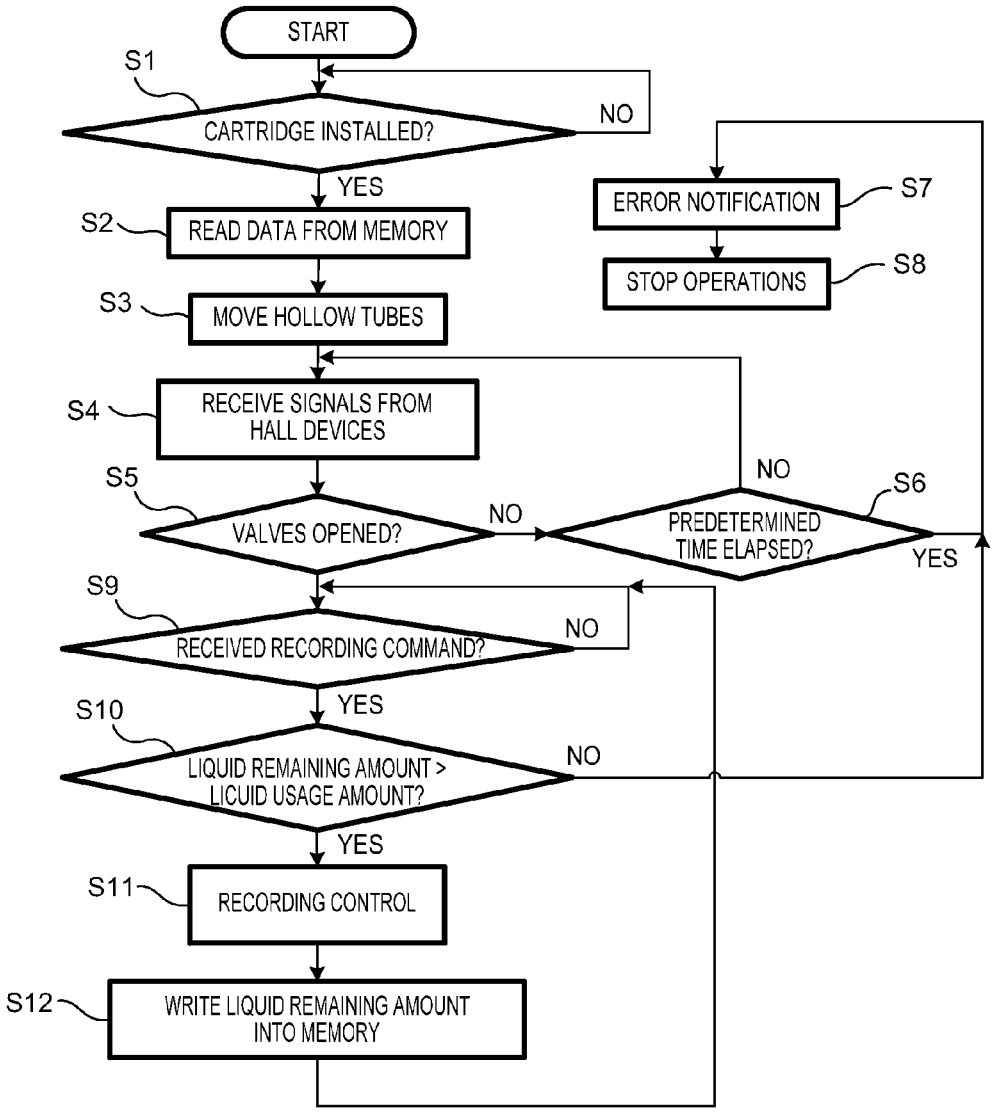
FIG. 14 is a flowchart depicting control executed by a controller of a printer according to an embodiment of the invention.

The controller 100 may further comprise a communication section for performing communications with the cartridge 40 installed in the space C, as depicted in FIG. 13, and also may comprise each section corresponding to the processing steps depicted in FIG. 14.

A cartridge installation detecting section M1 may correspond to the processing of step S1. A reading section M2 may correspond to the processing of step S2. A notification control section M3 may correspond to the processing of step S7. A recording prohibiting section M4 may correspond to the processing of step S8. A moving control section M5 may correspond to the processing of step S3. A receiving section M6 may correspond to the processing of step S4. A writing section M7 may correspond to the processing of step S12. A recording control section M8 may correspond to the processing of step S11. A fluid communication determining section M9 may correspond to the processing of step S5. A sealing control section M10 may correspond to the sealing operation. A humidity control section M11 may embody the humidifying operation.

Referring to FIG. 16, the printer 1 may perform the humidifying operation by a humidifying mechanism 90. The humidifying mechanism 90 may comprise joints 91, tubes 95, 96, 97, a pump 93, and the tank 94.

Two joints 91 may be provided for each head 2. In each head 2, one of the joints 91 may be fixed to one end of the frame 3 the other of the joints 91 may be fixed to the other end of the frame 3 with respect to a longitudinal direction of the head 2. The joints 91 may have a substantially cylindrical shape. Each joint 91 may have an opening 91*a* in its lower surface, and the opening 91*a* may be in fluid communication with an internal space defined in the sealing member 2*c*. The tube 95 may connect the pump 93 and the one of the joints 91 to allow fluid communication therebetween. The tube 96 may connect the pump 93 and the tank 94 to allow fluid communication therebetween. The tube 97 may connect the tank 94 and the other of the joints 91 to allow fluid communication therebetween.

Although the tubes 95 and 97 corresponding to one of the heads 2 are depicted in FIG. 16, the tubes 95 and 97 may be also provided to the other of the heads 2. The printer 1 may comprise the single pump 93 and the single tank 94. The two tubes 95 extending from the respective heads 2 may be connected to the pump 93, and the two tubes 97 extending from the respective heads 2 may be connected to the tank 94.

The tank 94 may store humidifying liquid supplied from the reservoir 42H in its lower portion and air humidified by the humidifying liquid in its upper portion. The tube 96 may be in fluid communication with the lower portion of the tank 94, and the tube 97 may be in fluid communication with the upper portion of the tank 94. A check valve may be attached to the tube 96 to allow air to flow through the tube 96 in one direction, as indicated by a black arrow in FIG. 16. This configuration may prevent or reduce backflow of the humidifying liquid stored in the tank 94.

The sealing-member up-and-down mechanism 2*c*M may comprise gears and a gear motor. The gears may be configured to engage with the respective sealing members 2*c*. The gear motor may be configured to drive the gears. In the sealing operation, the controller 100 may control the sealing-member up-and-down mechanism 2*c*M, as depicted in FIG. 12, to move the sealing members 2*c* downward. Thus, in each head 2, an end of the sealing member 2*c*, e.g., lower ends in FIG. 16, may be located lower than the lower surface 2*a* of the head 2 and may contact the outer surface 8*a* of the transport belt 8. A discharge space R1 between the lower surface 2*a* of the head 2 and the outer surface 8*a* of the transport belt 8 may be sealed and isolated from an external space R2 when the sealing member 2*c* is in a sealing position. During recording, the sealing member 2*c* may be disposed in a recording position at which the end of the sealing member 2*c* may be disposed higher than the lower surface 2*a*. The recording position may be higher than the sealing position. The controller 100 may perform the sealing operation to move the sealing members 2*c* from the recording position to the sealing position when the controller 100 determines that a recording command has not been received for a predetermined time or more.

In the humidifying operation, the controller 100 may drive the pump 93 while keeping the sealing members 2*c* in the sealing position. With the driving of the pump 93, air in the discharge space R1 may be recovered via the opening 91*a* of the one of the joints 91, and the air may flow into the lower space of the tank 94 through the tube 95, the pump 93, and the tube 96. The recovered air may be humidified by the humidifying liquid stored in the tank 94 and then discharged from the upper space of the tank 94. The discharged air may be supplied back to the discharge space R1 through the tube 97 via the opening 91 of the other of the joints 91. In FIG. 16, the flow of air before humidification may be indicated with black arrows, and the flow of air after humidification may be indicated with white arrows.

The humidifying operation may prevent or reduce an increase of the viscosity of the liquid that may clog the nozzles. Further, the humidifying operation may reduce a frequency of performance of a preliminary ejection, e.g., one or both of purging and flushing, and the consumption of the black ink and the pretreatment liquid.

For example, the humidifying operation may be performed once a day, when the sealing members 2*c* are located in the sealing position for a predetermined period or more.

As describe above, the cartridge 40 may comprise therein the reservoir 42B for storing black ink, the reservoir 42P for storing pretreatment liquid, and the reservoir 42H for storing humidifying liquid. This configuration may facilitate the installation and removal of the cartridge 40 and accomplish the supply of the three different kinds of liquid to the corresponding heads 2 by one-time cartridge installation.

The relationship among the liquid storage amounts V1, V2, and V3 of the reservoirs 42B, 42P, and 42H may satisfy V1>V2>V3.

A relationship between an amount of black ink to be used and an amount of pretreatment liquid to be used during recording of an image onto a sheet P may be obtained by, for example, the following equation:

$$U2=U1\times(1/5-1/10)$$

U1 may represent the amount of black ink to be used and U2 may represent the amount of pretreatment liquid to be used. An amount of humidifying liquid to be used during humidifying operation U3 may be obtained by, for example, the following equations:

$$U3=U1\times(1/20-1/100)\text{ (when moisture is added to the black ink)}$$

$$U3=U2\times(1/20-1/100)\text{ (when moisture is added to the pretreatment liquid)}$$

The humidifying liquid may be used to add moisture to the nozzles of each head 2. Normally, the amount of humidifying liquid to be used during the humidifying operation may be less than the amounts of black ink and pretreatment liquid discharged from the nozzles during recording. In some cases, the pretreatment liquid may not be used in accordance with one or more of a type of a sheet P to be used and a recording mode, e.g., a color printing mode, a monochrome printing mode, a photo printing mode, or a document printing mode. For example, when a sheet P to be used is a relatively thick paper or glossy paper or when the recording mode is a photo printing mode, the recording may be performed without using the pretreatment liquid.

The liquid storage amounts V1, V2, and V3 of the reservoirs 42B, 42P, and 42H may satisfy an effective relationship in view of the consumption of each liquid in the printer 1. Therefore, when the reservoir 42B becomes empty of black ink, the amount of pretreatment liquid remaining in the reservoir 42P and the amount of humidifying liquid remaining in the reservoir 42H may be low. Thus, the above-described relationship may reduce waste of one or both of the pretreatment liquid and the humidifying liquid due to replacement of the cartridge 40. Consequently, the reduction of the liquid wastes may reduce cost and be friendly to the environment.

If the liquid storage amounts V1, V2, and V3 of the reservoirs 42B, 42P, and 42H do not satisfy the above-described relationship and one or both of the amount of pretreatment liquid stored in the reservoir 42P and the amount of humidifying liquid stored in the reservoir 42H are greater than actually required, the cartridge 40 may become greater in size. Therefore, satisfying the above-described relationship may reduce the size of the cartridge 40.

The relationship among the capacities C1, C2, and C3 of the reservoirs 42B, 42P, and 42H may satisfy C1>C2>C3. Therefore, the size of the reservoirs 42B, 42P, and 42H may be reduced and the size of the cartridge 40 may be reduced correspondingly.

As depicted in FIG. 4, each reservoir 42B, 42P, and 42H may comprise a bag that may comprise two sheets overlaying each other with the ink outlet tube 43 sandwiched therebetween and edges of the sheets may be adhered to each other by heat. This configuration may reduce the size of each reservoir 42B, 42P, and 42H and the size of the cartridge 40 correspondingly.

Each reservoir 42B and 42P may have the crease lines 42Bi and 42Pi formed in the surfaces 42Bs and 42Ps and extending in the direction perpendicular to the edges to which the ink outlet tube 43 is attached, and may be configured to be folded inward at the crease lines 42Bi and 42Pi as the amount of liquid stored in the reservoir 42B and 42P decreases. With this configuration, the capacity C1 and C2 of each reservoir 42B and 42P may be increased while the size of each reservoir 42B, 42P, and 42H may be reduced.

The reservoir 42H may be configured such that surfaces extending in the direction perpendicular to the edge to which the ink outlet tube 43 is attached may not be folded inward as the amount of liquid stored in the reservoir 42H decreases. With this configuration, the capacity C3 of the reservoir 42H may be reduced while the size of each reservoir 42B, 42P, and 42H may be reduced.

As depicted in FIG. 5, the reservoir 42H may be disposed next to the reservoirs 42B and 42P with respect to the first cartridge direction while its longer side of the cross section may extend parallel to the third cartridge direction and its shorter side of the cross section may extend parallel to the first cartridge direction. Further, the length L3 of the longer side of the cross section of the reservoir 42H may be less than the sum of the lengths W1, W2, and W3 of the shorter sides of the cross sections of the reservoirs 42B, 42P, and 42H, e.g., the relationship of L3<(W1+W2+W3) may be satisfied. With this configuration, the lengths of the longer sides, which may extend along the first cartridge direction, and shorter sides, which may extend along the third cartridge direction, of the cross sections of the reservoirs 42B and 42P may be reduced, and thus, the entire size of each reservoir 42B, 42P, and 42H may be reduced. Therefore, the cartridge 40 may supply the heads 2 with three different types of liquid while maintaining a reduced size.

The length L3 of the longer side of the cross section of the reservoir 42H may be less than or equal to the sum of the lengths W1 and W2 of the shorter sides of the cross sections of the reservoirs 42B and 42P, e.g., the relationship of L3≤(W1+W2) may be satisfied. Therefore, liquid levels may substantially be the same among the reservoirs 42B, 42P, and 42H, and thus, the pressure difference among the liquid stored in the respective reservoirs 42B, 42P, and 42H may be reduced. This effectiveness may be obtained when the cartridge 40 is oriented in a predetermined posture, e.g., when the reservoir 42H may be disposed next to the reservoirs 42B and 42P with respect to the first cartridge direction while its longer side of the cross section may extend parallel to the third cartridge direction and its shorter side of the cross section may extend parallel to the first cartridge direction.

The center O3 of the opening 43*b* communicating with the reservoir 42H may be disposed between the center O1 of the opening 43*b* communicating with the reservoir 42B and the center O2 of the opening 43*b* communicating with the reservoir 42P with respect to the third cartridge direction. With this configuration, the openings 43*b* communicating with the respective reservoirs 42B, 42P, and 42H may be disposed closer to each other with respect to the third cartridge direction. Thus, the three hollow tubes 153 configured to be inserted into the corresponding openings 43*b* may be disposed closer to each other with respect to the vertical direction correspondingly and a size of the support member 154 comprising the hollow tubes 153 may be reduced.

In the above-described illustrative embodiment, the center O1 of the opening 43*b* communicating with the reservoir 42B may be located closer to the reservoir 42H than the center of the reservoir 42B with respect to the first cartridge direction. The center O2 of the opening 43*b* communicating with the reservoir 42P may be located closer to the reservoir 42H than the center of the reservoir 42P with respect to the first cartridge direction. With this configuration, the openings 43*b* corresponding to the respective reservoirs 42B, 42P, 42H may be disposed closer to each other with respect to the first cartridge direction. Thus, the three hollow tubes 153 configured to be inserted into the corresponding openings 43*b* may be disposed closer to each other with respect to the third cartridge direction correspondingly and the size of the support member 154 comprising the hollow tubes 153 may be reduced.

The hand well portion 49 may be provided in the recessed portion that may face the reservoir 42P with respect to the first cartridge direction and the reservoir 42H with respect to the third cartridge direction, e.g., the hand well portion 49 may be disposed on the right of the reservoir 42P and above the reservoir 42H in FIG. 5. Thus, the hand well portion 49 may be disposed in the space remaining in the housing 41 of the cartridge 40 after the arrangement of the reservoirs 42B, 42P, and 42H. In another embodiment, the space for the hand well portion 49 may be defined first and then the reservoirs 42B, 42P, and 42H may be disposed in the remaining space in the housing 41. Accordingly, usage efficiency of the space inside of the housing 41 may be improved.

The one or more walls defining the hand well portion 49 may be configured to hold the reservoirs 42P and 42H. With this configuration, the one or more walls may maintain the posture of the reservoirs 42P and 42H. Further, the one or more walls defining the hand well portion 49 may have a function of holding the reservoirs 42P and 42H. Therefore, the structure of the cartridge 40 may be simplified.

The recessed portion 41*r* may be provided in the recessed portion facing the reservoir 42P with respect to the first cartridge direction and the reservoir 42B with respect to the third cartridge direction, e.g., the recessed portion 41*r* may be defined at the left of the reservoir 42P and above the reservoir 42B in FIG. 5. The outer surface 41*g* defining the recessed portion 41*r* may have the hollow 48. The recessed portion and the hollow 48 may function as a retaining portion for retaining the housing 41 of the cartridge 40 in the housing 1*a* of the printer 1 when the cartridge 40 is mounted in the space C. With this configuration, the retaining portion comprising the recessed portion 41*r* and the hollow 48 may be disposed in the space remaining in the housing 41 of the cartridge 40 after the arrangement of the reservoirs 42B, 42P, and 42H. Accordingly, the usage efficiency of the space inside of the housing 41 may be improved.

The recessed portion 41*r* may be an unused space in the housing 41. The outer surface 41*g* defining the unused space may have the hollow 48 and the engagement member 148 of the printer 1 may be disposed in the unused space of the cartridge 40 when the cartridge 10 is mounted in the space C, as depicted in FIG. 10A. Thus, the unused space of the cartridge 40 may be effectively used.

The one or more walls defining the recessed portion 41*r*, e.g., walls defining the outer surfaces 41*g* and 41*h*, may be configured to hold the reservoirs 42B and 42P. Therefore, the one or more walls defining the recessed portion 41*r* may maintain the posture of the reservoirs 42B and 42P. Further, the one or more walls, e.g., the recessed portion 41*r*, may have a function of holding the reservoirs 42B and 42P. Therefore, the structure of the cartridge 40 may be simplified.

The cross section of each reservoir 42B and 42P may have a substantially rectangular shape and the cross section of the reservoir 42H may have a substantially ellipse shape. The one surface 42Ps of the surfaces 42Ps, which faces the reservoir 42H, e.g., the right surface 42Ps of the reservoir 42P in FIG. 5, may be disposed closer to the reservoir 42H than the one surface 42Bs of the surfaces 42Bs, which faces the reservoir 42H, e.g., the right surface 42Bs of the reservoir 42B in FIG. 5, with respect to the first cartridge direction, and the reservoirs 42P and 42H may partially overlap each other when viewed in the third cartridge direction. As described above, the reservoir 42P may be disposed near the one of the surfaces of the reservoir 42H having the ellipse shape in cross section and the reservoirs 42P and 42H may be disposed adjacent to each other. With this arrangement, the reservoirs 42B, 42P, and 42H may be effectively arranged in the housing 41. More specifically, the space in the housing 41 may be effectively used, e.g., the retaining portion comprising the recessed portion 41*r* and the hollow 48 may be disposed in the space provided opposite to the reservoir 42H with respect to the reservoir 42P, e.g., on the left of the reservoir 42P in FIG. 5.

The partition 41*p* may facilitate the precise positioning of the reservoirs 42B and 42H. The partition 41*p* may not overlap the reservoir 42P with respect to the first cartridge direction. Therefore, the partition 41*p* may not interfere with the close arrangement of the reservoir 42P and the reservoir 42H.

In another embodiments, in a liquid cartridge, a first liquid may comprise one of a color ink, e.g., cyan, magenta, or yellow, instead of black ink. A color material of the first liquid may be pigments or dyes.

A second liquid may comprise a liquid that may have a function of coagulating the color material included in the first liquid. The second liquid may comprise liquid that may be discharged onto a recording medium having an image to improve quality of the recorded image.

A third liquid may comprise a liquid that may be used to add moisture to one of the first liquid and the second liquid.

A size of an ink droplet of the first liquid discharged from a first head may be the same as or different from a size of an ink droplet of the second liquid discharged from a second head. For example, the size of the ink droplet of the first liquid discharged from the first head may be selected from three volumes, e.g., 7 pL, 10 pL, and 14 pL ("pL" stands for picoliter), in accordance with the number of discharging ink droplets in one recording cycle, and the size of the ink droplet of the second liquid discharged from the second head may be selected from one volume, e.g., 5 pL.

In another embodiments, each reservoir may comprise a box comprising one or more plates that may have a greater thickness than the sheets.

In another embodiment, the cross section of all of the first to third reservoirs may be various shapes, e.g., a rectangle, ellipse, or circle. The first to third reservoirs may be aligned along one direction. The first to third reservoirs may be disposed such that their discharge directions may be different from each other.

Centers of discharge ports communicating with the first and second reservoirs, respectively, may not be located off-center from the respective centers of the first and second reservoirs.

A partition disposed between the first reservoir and the third reservoir may overlap the second reservoir with respect to a first direction. The partition may be omitted from the liquid cartridge.

A surface, which may face the third reservoir, of the second reservoir may not be located closer to the third reservoir than a surface, which may face the third reservoir, of the first reservoir, with respect to the first direction. The second and third reservoir may not overlap each other with respect to the first direction.

The retaining portion may be disposed at a position other than a space that may be opposite to the second reservoir with respect to the first direction and opposite to the first reservoir with respect to a second direction. The retaining portion may be omitted from the liquid cartridge.

A hand-held portion may be disposed at a position other than a space that may be opposite to the second reservoir with respect to the first direction and opposite to the third reservoir with respect to the second direction. The hand-held portion may be omitted from the liquid cartridge.

A center of a first discharge port and a center of a second discharge port may not be located off-center from the center of the first reservoir and the center of second reservoir, respectively.

A center of a third discharge port may not be disposed between the center of the first discharge port and the center of the second discharge port with respect to the second direction.

A length of a longer side of the cross section of the third reservoir may be less than a sum of lengths of shorter sides of the cross sections of the first, second and third reservoirs. In another embodiment, the length of the longer side of the cross section of the third reservoir may be greater than a sum of the lengths of the shorter sides of the cross sections of the first and second reservoirs.

The third reservoir may be disposed on the side of at least the first reservoir with respect to the first direction. Therefore, the third reservoir may not necessarily be disposed on the side of the second reservoir with respect to the first direction. The reservoir 42H may be disposed adjacent to the reservoirs 42B and 42P with respect to the first cartridge direction, as depicted in FIG. 5. In another embodiment, for example, the reservoir 42H may be disposed lower than a lower surface of the reservoir 42P and not on the side of the reservoir 42H with respect to the first cartridge direction.

The discharge port and the reservoir may comprise one piece or separate parts. The discharge port and the reservoir may comprise separate parts. Thus, the ink outlet tubes 43 may be attached to the bag-shaped reservoirs 42B, 42P, and 42H, respectively. For example, the reservoir may be a box comprising one or more plates having a greater thickness than the sheets and an opening formed in the box may serve as the discharge port.

In the liquid cartridge, each part constituting the liquid cartridge may be arbitrarily changed or modified, one or more new parts may be added, or one or more parts may be omitted without departing from the spirit and scope of the claims of the invention.

In a liquid ejecting apparatus, a structure of a humidifying unit may be arbitrarily changed. In another embodiments, a pump and a tank may be provided for each head.

The image recording device may be a color inkjet printer comprising heads for discharging inks of black, magenta, cyan, and yellow.

The image recording device may be a line-type image recording device, a serial-type image recording device, or the like. In another embodiment, the image recording device may be a facsimile machine or a copying machines, or any other suitable machine for ejecting ink, for example.

The recording medium may be not only papers but also any suitable media, for example, cloth.

In the liquid ejecting apparatus, each part constituting the liquid ejecting apparatus may be arbitrarily changed or modified, one or more other parts may be added, or one or more parts may be omitted without departing from the spirit and scope of the claims of the invention.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

What is claimed is:

1. A cartridge, comprising:

an engagement portion disposed on a first surface facing a first direction;

a first reservoir storing a first liquid comprising a colorant;

a second reservoir storing a second liquid comprising a characteristic of coagulating the colorant; and a third reservoir storing a third liquid comprising water, wherein each of the first, the second, and the third reservoirs comprises an outlet portion configured to direct liquid from an interior of the respective reservoirs to an exterior of the cartridge in a second direction perpendicular to the first direction, and wherein the outlet portions of the first, the second, and the third reservoirs are disposed such that a line extending along the first direction, on a plane comprising the outlet portions, does not intersect more than one of the outlet portions of the first, the second, and the third reservoirs.

2. The cartridge of claim 1, wherein the outlet portion of the first reservoir overlaps with the outlet portion of the third reservoir in a third direction perpendicular to the first direction and the second direction.

3. The cartridge of claim 1, wherein the outlet portion of the second reservoir is disposed between the outlet portions of the first and the third reservoirs in a third direction perpendicular to the first direction and the second direction.

4. The cartridge of the claim 1, wherein a portion of the outlet portion of the third reservoir is disposed upstream from the outlet portion of the second reservoir and downstream from the outlet portion of the first reservoir in the first direction.

5. The cartridge of claim 1, wherein the outlet portion of the first reservoir is disposed between engagement portion and the outlet portion of the second reservoir in a third direction perpendicular to the first direction and the second direction.

6. The cartridge of claim 1, wherein the engagement portion is disposed between the outlet portions of the second reservoir and the third reservoir in the first direction.

7. The cartridge of claim 1, wherein the outlet portion of the second reservoir does not overlap with the outlet portion of the first reservoir or the outlet portion of the third reservoir in a third direction perpendicular to the first direction and to the second direction.

8. The cartridge of claim 1, wherein the third reservoir overlaps with each of the first reservoir and the second reservoir in a third direction perpendicular to the first direction and to the second direction.

9. The cartridge of claim 1, wherein the first reservoir overlaps with the engagement portion in the first direction.

10. The cartridge of claim 1, wherein the engagement portion does not overlap with any of the first, the second, or the third reservoirs in the second direction.

11. The cartridge of claim 1, wherein a relationship among amounts of the liquid stored in the first, second, and third reservoirs is V1>V2>V3, where V1 is an amount of the first liquid stored in the first reservoir, V2 is an amount of the second liquid stored in the second reservoir, and V3 is an amount of the third liquid stored in the third reservoir.

12. The cartridge of claim 11, wherein a relationship among capacities of the first, second, and third reservoirs is C1>C2>C3, where C1 is a capacity of the first reservoir, C2 is a capacity of the second reservoir, and C3 is a capacity of the third reservoir.

13. The cartridge of claim 1, wherein the first, second and third reservoirs each comprises a bag storing the first liquid, the second liquid, and the third liquid, respectively, wherein each of the outlet portions of the first, second, and third reservoirs comprises an outlet tube, and wherein each of the bags comprises sheets sandwiching the liquid outlet tube.

14. The cartridge of claim 13, wherein at least one of the first reservoir and the second reservoir comprises two surface each extending parallel to the second direction and each has creases extending in the second direction, such that the two surfaces each folds inward at the creases when the amount of liquid stored in the at least one of the first reservoir and the second reservoir decreases.

15. The cartridge of claim 13, wherein the third reservoir comprises surfaces extending parallel to the second direction and configured not to fold inward when the amount of the third liquid stored in the third reservoir decreases.

16. The cartridge of claim 1, wherein a length of the third reservoir in the first direction is less than a sum of a length of the first reservoir in the first direction, a length of the second reservoir in the first direction, and a length of the third reservoir in the third direction.

17. The cartridge of claim 1, wherein a length of the third reservoir in the first direction is less than or equal to a sum of a length of the first reservoir in the first direction and a length of the second reservoir in the first direction.

18. The cartridge of claim 1, wherein the output portion of the first reservoir is disposed between the third reservoir and a center of the first reservoir with respect to the third direction.

19. The cartridge of claim 1, wherein the output portion of the second reservoir is disposed between the third reservoir and a center of the second reservoir with respect to the third direction.

20. The cartridge of claim 1, wherein a cross section of each the first reservoir and the second reservoir has a rectangular shape and a cross section of the third reservoir has an elliptical shape.

21. The cartridge of claim 1 further comprising a substrate surface on which an electrical terminal is disposed, the substrate surface facing a third direction perpendicular to the first direction and the second direction.

22. A cartridge, comprising:

a first reservoir storing a first liquid comprising a colorant;

a second reservoir storing a second liquid comprising a characteristic of coagulating the colorant; and a third reservoir storing a third liquid comprising water, without colorant or liquid comprising a characteristic of coagulating colorants.

23. A cartridge, comprising:

an engagement portion disposed on a first surface facing a first direction;

a first reservoir;

a second reservoir; and a third reservoir, wherein each of the first, the second, and the third reservoirs comprises an outlet portion extending in a second direction perpendicular to the first direction and configured to communicate an interior of the respective reservoirs with an exterior of the cartridge, and wherein the outlet portions of the first, the second, and the third reservoirs are disposed such that a line extending along the first direction, on a plane comprising the outlet portions, does not intersect more than one of the outlet portions of the first, the second, and the third reservoirs.

* * * * *